US006194648B1

(12) United States Patent
Takahashi et al.

(10) Patent No.: US 6,194,648 B1
(45) Date of Patent: Feb. 27, 2001

(54) ELECTRONIC MUSICAL INSTRUMENT

(75) Inventors: Shigeru Takahashi; Hiromu Katayama, both of Nagano (JP)

(73) Assignee: Roland Corporation, Los Angeles, CA (US)

( * ) Notice: Subject to any disclaimer, the term of this patent is extended or adjusted under 35 U.S.C. 154(b) by 0 days.

(21) Appl. No.: 09/238,488

(22) Filed: Jan. 27, 1999

(30) Foreign Application Priority Data

Jan. 28, 1998 (JP) ..... 10-030539
Jan. 28, 1998 (JP) ..... 10-030638
Jan. 28, 1998 (JP) ..... 10-030639

(51) Int. Cl.[7] ..... G10H 7/00; G10H 1/18

(52) U.S. Cl. ..... 84/615; 84/600; 84/601; 84/602; 84/653

(58) Field of Search ..... 84/601–604, 609, 84/615, 616, 618, 649, 653–654, 656, 600

(56) References Cited

U.S. PATENT DOCUMENTS

| | | | | |
|---|---|---|---|---|
| 4,672,876 | | 6/1987 | Sugiyama et al. | 84/1.03 |
| 4,681,008 | | 7/1987 | Morikawa et al. | 84/1.28 |
| 4,882,964 | * | 11/1989 | Okamoto et al. | 84/618 |
| 4,926,738 | * | 5/1990 | Kondo et al. | 84/618 |
| 5,243,125 | | 9/1993 | Yamaguchi | 84/745 |
| 5,247,128 | | 9/1993 | Suzuki | 84/611 |
| 5,281,756 | * | 1/1994 | Kawashima | 84/615 |

FOREIGN PATENT DOCUMENTS

| | | |
|---|---|---|
| 63-62759 | 12/1986 | (JP) . |
| 05120847 | 5/1993 | (JP) . |
| 06195071 | 7/1994 | (JP) . |
| 06230770 | 8/1994 | (JP) . |
| 06348254 | 12/1994 | (JP) . |
| 07168569 | 7/1995 | (JP) . |
| 7-36389 | 8/1995 | (JP) . |

(List continued on next page.)

OTHER PUBLICATIONS

Roland Corporation, R–8 Human Rhythm Composer, Owner's Manual, 1988, pp. 3–5, 11, 27, 58, 61–64.

Roland Corporation, R–8 Human Rhythm Composer, Owner's Manual, 1988, pp. 3–5, 11, 14–15,17, 40–42.

Roland Corporation, Multitrack Manager Software—DM–80–S, Owner's Manual, pp. 1–5, 9, 10.

Roland Corporation, Digital Studio Workstation, VS–880, Owner's Manual, pp. 5–7, 10–13, 22.

Roland Corporation, MIDI Pad–MIDI Interface, PM–16, Owner's Manual, pp. 1, 2, 17–31, 60–63.

Roland Corporation, JV–2080, 64 Voice Synthesizer Module, 3x EFX 8x Expansion, Owner's Manual, 1996, pp. 4, 5, 12–14, 63–66, 70, 71, 76.

(List continued on next page.)

*Primary Examiner*—Marlon Fletcher
(74) *Attorney, Agent, or Firm*—Foley & Lardner

(57) ABSTRACT

Embodiments of the instant invention include a plurality of first operators which, together with the assignment of each of the musical tones being possible, designate the start of reproduction of the musical tones that have been assigned in accordance with their operation and a first control means with which any of the first operators are selected from among the plurality of the first operators and together with the cancellation of the assignment to the first operators that have been selected of the musical tones that had previously been assigned to the selected first operators, the musical tones themselves that had previously been assigned to the selected first operators or the pointers that indicate the musical tones that had previously been assigned to the selected first operators are stored and a second control means in which the musical tones themselves or the pointers that indicate the musical tones which have been stored in the first control means and any of the first operators from among the plurality of first operators are selected and assignments are made. Embodiments further include a display control means for displaying the state of assignment for the plurality of operators.

31 Claims, 11 Drawing Sheets

FOREIGN PATENT DOCUMENTS

| | | |
|---|---|---|
| 2528586 | 2/1996 | (JP) . |
| 09022288 | 1/1997 | (JP) . |
| 09146554 | 6/1997 | (JP) . |
| 10049166 | 2/1998 | (JP) . |

OTHER PUBLICATIONS

Roland Corporation, Paul D. Lehram, Roland S–770 Digital Sampler with SYS–772 Version 2.0 Operating System, 1991, Table of Contents, pp. 76, 83–93.

BOSS, SP–202, Dr. Sample, Owner's Manual, pp. 4–7, 12, 14 ©1997.

Boss SP–202 Dr. Sample Owner'Manual ©1997.

Roland Dm–800 Multi Track Disc Recorder Owner's Manual.

Cakewalk Pro Audio 6.0 User's Guide.

* cited by examiner

PAD OPERATOR MANAGEMENT MAP

| BANK NUMBER | PAD NUMBER | WAVEFORM DATA STORAGE LOCATION | PRESENCE OR ABSENCE OF WAVEFORM DATA ASSIGNMENT |
|---|---|---|---|
| 1 | 1 | | |
| 1 | 2 | | |
| 1 | 3 | | |
| | | | |
| | | | |
| | | | |
| 9 | 14 | | |
| 9 | 15 | | |
| 9 | 16 | | |

FIG. 3

CURRENT BANK NUMBER

| |
|---|

FIG. 4

ELECTRONIC MUSICAL INSTRUMENT

RELATED APPLICATIONS

This application claims priority to Japanese patent applications Heisei 10-30539 filed Jan. 28, 1998, Heisei 10-30638 filed Jan. 28, 1998 and Heisei 10-30639 filed Jan. 28, 1998, all of which were assigned to the applicant and are incorporated herein.

FIELD OF THE INVENTION

The present invention is directed to an electronic musical instrument. More specifically, embodiments of the instant invention are directed to an electronic musical instrument having a plurality of operators, wherein musical tones are assigned, or mapped, to the plurality of operators and wherein the musical tones that have been assigned to the operators are reproduced in accordance with the operation of each of the operators.

BACKGROUND OF THE INVENTION

In general, electronic musical instruments are known which have a plurality of operators, wherein musical tones are assigned, or mapped, in advance to each of these plurality of operators by such means as the assignment of waveform data that represents the musical tones, and wherein the musical tones that have been assigned to the appropriate operators are read out and reproduced in accordance with the operation of each of the operators. Previously, for this type of electronic musical instruments, it has been possible to assign or cancel the assignment of any musical tone desired to any operator at will. Unfortunately, in some past electronic musical instruments, it was not possible to differentiate and display the operators to which musical tones had been mapped and the operators to which musical tones had not been mapped. Since it is not possible to verify whether a musical tone has been mapped to an operator without undertaking the operation of the operator, there have been the problems that operators to which musical tones are not mapped are uselessly operated during the performance and the user becomes confused regarding which of the operators should be operated.

In particular, the problems described above have been strikingly apparent when changes are made to the state of the mapping of the musical tones to the operators such as canceling the mapping of musical tones to operators which, up to that point, have had musical tones mapped or carrying out the mapping of new musical tones to operators that, up to that point, have not had musical tones mapped.

Despite some of the problems, for the convenience of the performance operation, there are instances in which it is desirable to cancel the assignments of the musical tones that have been made to certain operators, referred to as "the first operators," and to assign these canceled musical tones to other operators, referred to as "the second operators". Nevertheless, for electronic musical instruments in which it is possible to assign any musical tone desired to any operator at will, changing the assignment of the musical tones from a first operator to a second operator has not been considered.

As it is possible in some electronic musical instruments to assign any musical tone desired to any operator at will, it is not impossible by some device of operation on the part of the user to assign the musical tones that have been assigned to the first operators to the second operators instead. For instance, a user can access the setting screen for the assignment of musical tones to the first operators, investigate which musical tones are assigned to which of the first operators and cancel those assignments. Next, the user can access the setting screen for the assignment of musical tones to the second operators and can assign the canceled musical tones to the second operators.

Although this procedure is possible, it is extremely troublesome and, in addition, it is subject to mistakes in the assignments of musical tones to operators, thereby increasing the likelihood of the occurrence of an erroneous operation. Further, due to the potentially random cancellation of musical tone assignments to the operators, the musical tones are not assigned to the plurality of operators in a series and thus, the assignment of the musical tones to the plurality of operators becomes scattered and is not necessarily sequential.

With the operators that do not have musical tones assigned, a problem arises in that, during a performance, a performer might mistakenly operate an operator that does not have a musical tone assigned. As no musical tone is assigned, no musical tone is reproduced and the performance is hampered.

If a performer attempts to carry out a performance so that operation mistakes such as that described above do not occur, the performer is placed under excessive strain which can lead to a lack of concentration during the performance.

In addition, it is only possible to assign one musical tone to each operator, because no more musical tones than the number of operators can be performed. In an attempt to increase the number of musical tones which can be played, patterns of musical tones have been established which can be assigned to each of the operators in a plurality of varieties. In this manner, it is possible to perform a greater number of musical tones than the number of operators by being able to select any of the patterns as desired.

However, in those cases where, for example, there are 16 operators, there is the problem that, when musical tones may have been assigned to only five of the operators in a certain pattern and musical tones may have been assigned to only seven of the operators in another pattern, if the patterns are not changed during the performance, all of these 12 (7+5) musical tones cannot be performed.

In addition, in those cases where it is desired to assign new musical tones to operators to which musical tones have not yet been assigned, when the operators to which musical tones have not yet been assigned are randomly arranged or scattered throughout the operators, there is the problem that it is difficult to carry out the assignment of the musical tones.

Embodiments of the present invention take into consideration the various problems presented by the technology of the past, such as those cited above. At least one objective of preferred embodiments of the instant invention is to present an electronic musical instrument which is configured to easily carry out the reassignment of musical tones from a first operator to a second operator.

Another objective of further embodiments of the present invention is to display whether a musical tone has been mapped to a particular operator.

Still a further objective of embodiments of the present invention is to present an electronic musical instrument with which, in those cases where there are operators to which no musical tones at all have been assigned, by a means of automatically assigning musical tones that have been assigned to other operators to the operators to which musical tones have not been assigned, the operators to which musical tones have been assigned are arranged in a relatively sequential, or concentrated, manner and it becomes easier to carry out a performance.

SUMMARY OF THE DISCLOSURE

Embodiments of the present invention comprise a plurality of operators, including a plurality of first operators to each of which it is possible to assign a musical tone, and a plurality of second operators to each of which it is possible to temporarily assign a musical tone, a first control means with which any of the first operators are selected from among the plurality of first operators and, together with the cancellation of the assignment to the first operators that have been selected of the musical tones, or pointers that indicate the musical tone, that had previously been assigned to the selected first operators, the musical tones, or pointers, that had previously been assigned to the selected first operators are assigned to the second operators; and a second control means in which the musical tones, or pointers that indicate the musical tone, that have been assigned to the second operators by the first control means and any of the first operators from among the plurality of first operators are selected and assignments are made.

Accordingly, in preferred embodiments, the musical tones that have been assigned to any of the first operators can be temporarily assigned to the second operators and the musical tones that have been temporarily assigned to the second operators can be easily assigned to any of the first operators.

With respect to the first and second operators in embodiments of the present invention, it is possible to commence the reproduction of the musical tones that have been assigned in accordance with the operation of the operator. With further respect to the second control means in embodiments of the present invention, the musical tones that have been assigned to the second operators by the first control means, and any of the first operators from among the plurality of first operators, can be selected and assigned. Further, the assignment to the second operators of the musical tones that have been previously assigned to the second operators can be canceled.

Accordingly, in embodiments of the present invention, it is possible to easily assign the musical tone, as represented by waveform data, that have been assigned to any of the operators to any other of the operators. For the patterns of musical tones that are assigned to the first operators, a plurality of varieties are established and it is possible to select any of the assigned patterns, that is, reassignments are performed independently in specified assignment patterns from a plurality of patterns. Further, in the second control means, the musical tones in any of the assigned patterns, the assignments of which were canceled by the first control means, may be selected and assigned to any of the first operators from among the plurality of first operators in another pattern.

Embodiments of the present invention further include a storage means or management information means, for storing the assignment information that indicates which of the musical tones have been assigned to the operators; an assignment change direction means in which changes in the state of the musical tone assignments for the operators are directed; an assignment change means, wherein, the musical tones that have previously been assigned to any of the operators are reassigned in order of the operators to which the musical tones have been assigned from a first operator to a last operator by means of the rewriting of the assignment information that has been stored in the storage means in accordance with the direction of a change in the state of the musical tone assignment by the assignment change direction means; and a reproduction means, wherein, in accordance with the start direction for reproduction in accordance with the operation of the operators, the musical tone that has been assigned to the operator that has been operated is reproduced based on the assignment information that has been stored in the storage means.

In accordance with embodiments of the present invention, the musical tones that have been assigned to any of the operators can be reassigned in the order of the operators to which the musical tones have been assigned from the first operator to the last operator. Due to the reassignment of the music tones to operators, the operators to which the musical tones have been assigned are arranged in a relatively sequential or concentrated manner and it is possible to carry out the performance easily.

In addition, because the operators to which operators have been assigned can be arranged in a relatively sequential or concentrated manner, the result is that the operators to which musical tones have not been assigned become arranged in a relatively sequential or concentrated manner and, thus, it becomes simple to assign new musical tones to these operators to which musical tones have not been assigned.

In accordance with the embodiments of present invention, the reassignment of the musical tones can be carried out independently with a plurality of patterns and it becomes possible to arrange the operators to which musical tones are assigned in a relatively sequential or concentrated manner in each pattern. Here, a plurality of patterns in which reassignment is carried out can be designated as desired and the reassignment carried out the patterns that have been designated.

Embodiments further include a pattern designation means in which any pattern is designated from among the plurality of patterns for the assignment of musical tones to the operators that are established in a plurality of varieties in a specified order, wherein the assignment change means reassigns in two or more of the above-mentioned patterns in the order of the patterns and in the order of the operators to which said musical tones have been assigned from the first operator to the last operator of the first pattern and, in addition, from the first operator to the last operator in the patterns that follow.

Furthermore, some preferred embodiments of the present invention include display means for displaying the assignment of musical tones to the plurality of first operators, and the assignment of musical tones to the second operators and display control means. Display devices have been established to correspond to each of the plurality of operators and the display control means controls the display devices wherein the control is based on the management information that has been stored in the management information storage means such that the state of the musical tone mapping for each of the plurality of operators is displayed in the display devices. Thus, because the display control means, which is based on the management information that indicates the state of the mapping of musical tones for each of the plurality of operators which direct the production of the musical tones that are mapped in accordance with their operation, controls the display devices that have been established to correspond to each of the plurality of operators, it is possible to display whether or not a musical tone is mapped to each of the operators.

In addition, when a change in the state of the mapping of the musical tones to each of the plurality of operators is directed by the change direction means, because the change means changes the management information in accordance with the direction by the change direction means, a display can always be performed in accordance with the new changed mapping.

This, according to embodiments of the present invention, the patterns of musical tone mapping to the plurality of operators are established in a plurality of varieties, wherein the management information that is stored in the management information storage means is information that indicates the state of the musical tone mapping for each of the plurality of operators in each of the plurality of patterns. Further, the particular pattern that has currently been selected from among the plurality of patterns and the direction of the changes in the state of the musical tone mapping by the change direction means is something in which the plurality of patterns are switched and the selection of any of the patterns is directed. The change means is one in which the information that indicates which of the patterns from among the plurality of patterns is currently selected is rewritten. Finally, the display control means is one in which, based on the information that indicates which of the patterns from among the plurality of patterns has been selected, the information that indicates the state of the musical tone mapping for each of the plurality of operators in the pattern that has currently been selected is referred to and the display devices are controlled.

With this configuration, it is possible to display whether a musical tone has been mapped for each of the operators in accordance with the pattern that is currently selected from among the plurality patterns for the mapping of musical tones to the operators.

This, according to embodiments of the present invention a musical tone input means with which new musical tones are input is provided. The change direction means is one which directs to which of the plurality of operators the musical tones that are input by the musical tone input means are mapped and the aforementioned change means is one in which the management information that indicates the state of the musical tone mapping for the operators that has been directed as the mapping by the change direction means for the musical tones that have been input by the musical tone input means is rewritten. With this configuration, it is possible to display operators to which there has been a mapping of musical tones that have been input from outside.

In addition, embodiments of the present invention may be implemented in which the display control means controls the display devices in a manner in which there is a first display mode which is concerned with the operators from among the plurality of operators to which the musical tones are mapped, a second display mode which is concerned with the operators from among the plurality of operators to which the musical tones are not mapped and a third display mode which is concerned with the operators from among the plurality of operators to which the musical tones that have been input by the musical tone input means are mapped. With this configuration, the operators to which musical tones have been mapped, the operators to which musical tones have not been mapped and the operators to which musical tones that have been input from outside are mapped can respectively be differentiated and displayed.

In addition, embodiments of the present invention may be implemented in which the change direction means directs the first operators and the second operators from among the plurality of operators to which the musical tones are mapped, and, together with the cancellation of the mapping relationship between the first operators and the musical tones that are mapped to the first operators, directs the mapping of the musical tones the correspondence relationship to the first operators, which have been canceled, to the second operators. The change means is one in which the management information that indicates the state of the mapping of the musical tones to at least the first operators is rewritten. With this configuration, it is possible to display changes in the mapping of musical tones to the first operators.

In addition, embodiments of the present invention may be implemented in which the plurality of operators are arranged in a specified order. Further, in the change direction means, together with the cancellation of the correspondence relationship between the operators from among the plurality of operators to which the musical tones have been mapped, and the musical tones that have been mapped to the operators, the musical tones that have had the correspondence relationship canceled are in an order that is prior to the operators from among the plurality of operators the correspondence relationships to the musical tones of which have been canceled. Moreover, mapping to other operators that do not have musical tones mapped is directed. With this configuration, it is possible to successively display the changes to the mapping of musical tones for each of the operators.

Embodiments of the present invention configured as described above can be advantageous in that, in an electronic musical instrument in which it is possible to change the mapping of musical tones to a plurality of operators, it is possible to display whether a musical tone has been mapped to each operator.

Embodiments of the present invention configured as described above, can be further advantageous in that, the reassignment of a musical tone that has been assigned to a certain operator to another operator can easily be performed.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

BRIEF DESCRIPTION OF THE DRAWINGS

The detailed description of preferred embodiments of the invention will be made with reference to the accompanying drawings, wherein like numerals designate corresponding parts in the figures.

FIG. 3 shows a preferred embodiment of a format of a pad operator management map in which the pad operator management map storage domain is stored in accordance with a preferred embodiment of the invention.

FIG. 4 is a diagram that depicts a preferred embodiment of a current bank number storage domain.

DETAILED DESCRIPTION OF PREFERRED EMBODIMENTS

Figure 1:
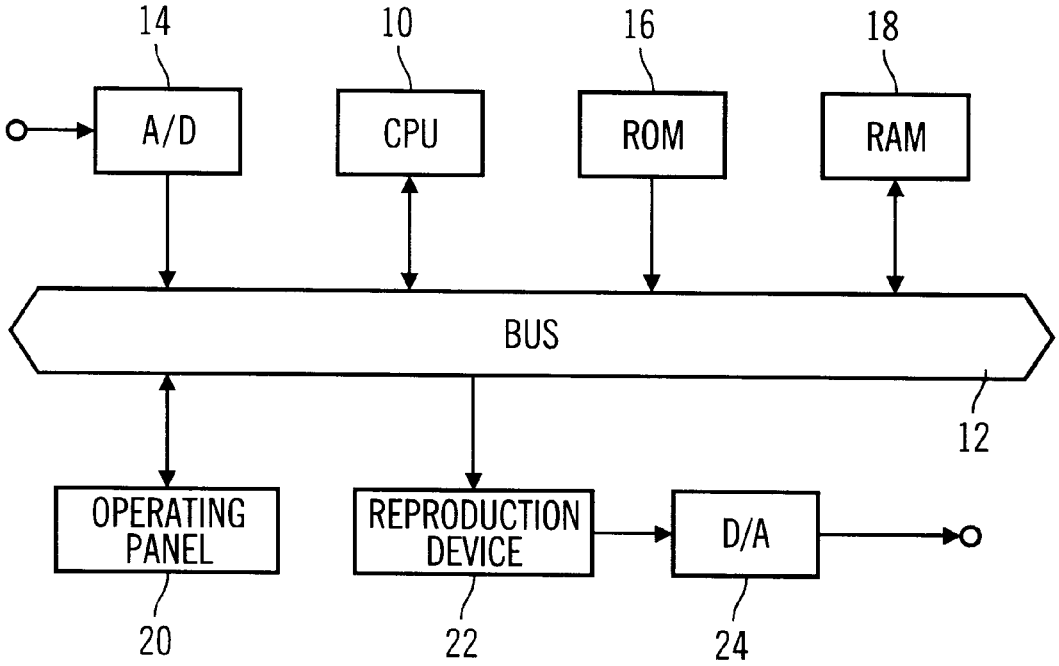
FIG. 1 is a block structural diagram that shows an overall configuration of an electronic musical instrument according to a preferred embodiment of the present invention.

Below, a detailed explanation will be given of a preferred embodiment of an electronic musical instrument with reference to the attached figures. FIG. 1 shows a block structural diagram that depicts an overall configuration of an electronic musical instrument in accordance with embodiments of the present invention.

The electronic musical instrument is preferably configured so that its overall operation is controlled using a central processing unit (CPU) 10. The electronic musical instrument further includes an analog to digital converter (A/D) 14; a read only memory (ROM) 16, (discussed later) which stores programs and data that are necessary for each kind of processing; a random access memory (RAM) 18, which, in addition to the working area required for processing, includes a waveform data storage domain, a pad operator management map storage domain and a current bank number storage domain; an operation panel 20, which includes an operator group for carrying out each kind of setting, operators for carrying out the performance (discussed later) and a display device; a reproduction device 22, which reproduces the waveform data; and a digital to analog converter (D/A) 24. Each of these elements is coupled to the CPU 10 through the bus 12.

As stated above, in the preferred embodiments of the electronic musical instrument shown in FIG. 1, the overall control of the operation is performed by the CPU 10. Sound signals, or musical tone signals, are input externally, converted by the analog to digital converter A/D 14 and stored as waveform data in the waveform data storage domain of the RAM 18, which is under the control of the CPU 10. In addition, the waveform data that have been stored in the waveform data storage domain of the RAM 18 are read out by the reproduction device 22, converted by the digital to analog converter D/A 24 and output as sound signals or musical tone signals.

Figure 2:
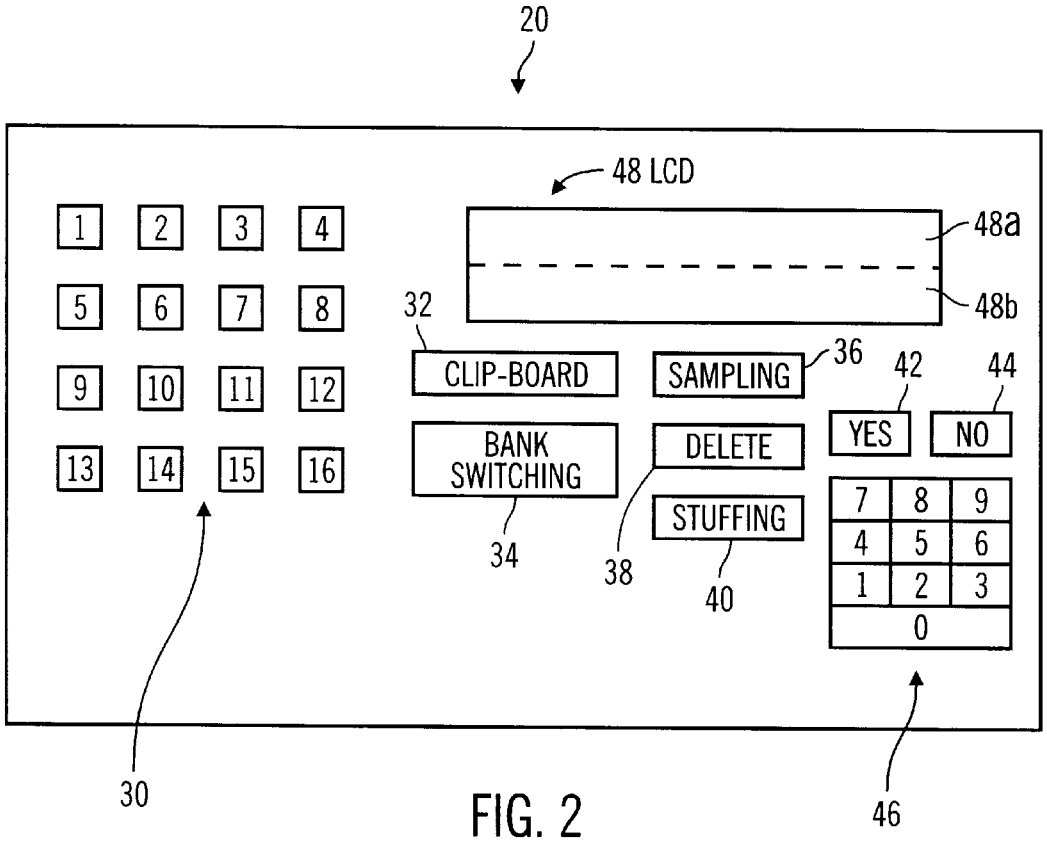
FIG. 2 is a two dimensional front view of an operating panel in accordance with the preferred embodiment of FIG. 1.

In FIG. 2, a preferred embodiment of the operation panel 20 is shown. The operation panel 20 comprises sixteen (16) pad operators 30 that are indicated by the numerical keys 1 to 16, a clip-board operator 32, a bank switching operator 34, a sampling operator 36, a delete operator 38, a stuffing operator 40, a Yes operator 42, a No operator 44, a ten-key pad 46 comprising the ten keys that are indicated by the FIGS. 0 to 9, and a second display device 48, wherein the second display device is a liquid crystal display apparatus (LCD).

The pad operators 30 are assigned the waveform data, which are referred to and managed by the pad operators 30 numbered 1 to 16. The waveform data that is assigned to a particular pad operator 30 is reproduced in accordance with the operation of the particular pad operators 30 to which it is assigned.

The clip-board operator 32 is an operator that is used when the assignment of the waveform data to a pad operator 30 is changed, wherein the waveform data are temporarily assigned to the clip-board operator 32 at the time of the change of assignment. Each of the pad operators 30 and the clip-board operator 32 are self-illuminated types which illuminate when waveform data have been assigned. When there have been no waveform data assigned, the lights are extinguished. As such, it is possible to distinguish at a glance between those operators that have waveform data assigned and those operators that do not have waveform data assigned.

In addition, when a pad operator 30 or the clip-board operator 32 that is lit is operated, the waveform data that have been assigned to the operator are reproduced. However, if a pad operator 30 or the clip-board operator 32 that is extinguished is operated, there is no reproduction of waveform data.

There are nine varieties of patterns for the waveform data that are assigned to each of the pad operators 30, wherein the pattern is called a "bank." In addition, at those times when the bank switching operator 34 is operated, the banks, or patterns, are switched in a specific order such that it is possible to select a bank as desired. The nine varieties of banks are referred to and managed by the bank numbers 1 to 9.

The sampling operator 36 is an operator for designating a shift to the sampling mode in order to record a sound signal that has been input externally. The sampling operator 36 is also self-illuminated.

The delete operator 38 is an operator that is used at the time of the cancellation of the assignment of the waveform data that have been assigned to a pad operator 30.

The stuffing operator 40 is used when there is a pad operator 30 that does not have waveform data assigned (an empty pad operator) and the pad operator 30 to which the waveform data is to be assigned has a pad number that is larger than the empty pad operator 30 in the bank, or pattern, of the empty pad operator 30. In addition, the stuffing operator 40 is used when the bank number of the bank of the pad operator 30 to which the waveform data is to be assigned is larger than the bank number of the bank of the empty pad operator 30. Instead of assigning the waveform data, sequentially, to the empty pad operators 30, the waveform data are assigned in a concentrated manner to the pad operators 30 having the smaller pad numbers in the bank having the smaller bank number. In addition, the ten-key pad 46 is used to designate, by the bank number, the object of the action for the reassignment of the waveform data by the stuffing operator 40.

The LCD 48 displays each kind of message and includes an upper and lower, two-area display screen. In the upper area display screen 48*a*, a message that indicates the current mode is displayed and, in the lower area display screen 48*b*, a message that suggests a selection for the user and a message that indicates the state of the current mode are displayed. The Yes operator 42 is operated when making a reply of "Yes" to a message that has been displayed on the LCD 48 and the No operator 44 is an operator that is operated when making a reply of "No" to a message that has been displayed on the LCD 48.

Regarding the RAM 18, as mentioned above, the RAM 18 includes a working area that is required for processing, a waveform data storage domain, a pad operator management map storage domain and a current bank number storage domain.

In FIG. 3, a preferred embodiment of the format of the pad operator management map which is stored in the pad operator management map storage domain is shown. As shown in FIG. 3, the pad operator management map stores, for each bank, or pattern, bank numbers 1 to 9, and for each pad operator 30, pad numbers 1 to 16, information that indicates the storage location for the waveform data that are assigned to a particular bank and a particular pad operator 30, that is, the waveform data storage location. Further, the pad operation management map stores information that indicates whether the waveform data have been assigned or not via a waveform data assignment flag indicator.

All of the waveform data are stored in the waveform data storage domain of the RAM 18 but, because the time length of each of the data is variable, the variable lengths for each of the waveform data of the storage domain are assigned in the waveform data storage domain. Because of this, in the pad operator 30 management map, for each pad operator 30, by means of the storage of information that indicates where the waveform data that corresponds to that pad operator 30 are stored in any of the storage locations in the waveform data storage domain, or waveform data storage location, a correspondence can be made between the pad operators 30 and the waveform data.

With regard to the clip-board operator 32, although it is not specifically shown in the figure, a storage domain is established in the RAM 18 that is the same as the pad operator management map for the pad operators 30 described above which stores information that indicates the waveform data storage location and information that indicates whether the waveform data have been assigned.

In addition, when the pad operators 30 and the clip-board operator 32 have been operated, the waveform data storage locations are derived based on the information that indicates the waveform data storage location. By the designation of the start of the reproduction of the waveform data of that storage location to the reproduction device 22, the reproduction of the waveform data is started. When the reproduction of the waveform data has been completed, the reproduction ceases.

FIG. 4 depicts a current bank number storage domain according to an embodiment of the invention. In the current bank number storage domain, the current bank number, of the bank that is currently selected, is recorded.

When the switching of the bank has been directed by the operation of the bank switching operator 34, the stored contents of the current bank number storage domain are rewritten with a new bank number, which is the bank number of the bank to which switching has been directed by the operation of the bank switching operator 34.

In addition, when a pad operator 30 has been operated, wherein the operation is based on the current bank number that has been stored in the current bank number storage domain, the region that corresponds to the pad operator 30 and the current bank number that has been operated is referred to in the pad operator management map.

Figure 5:
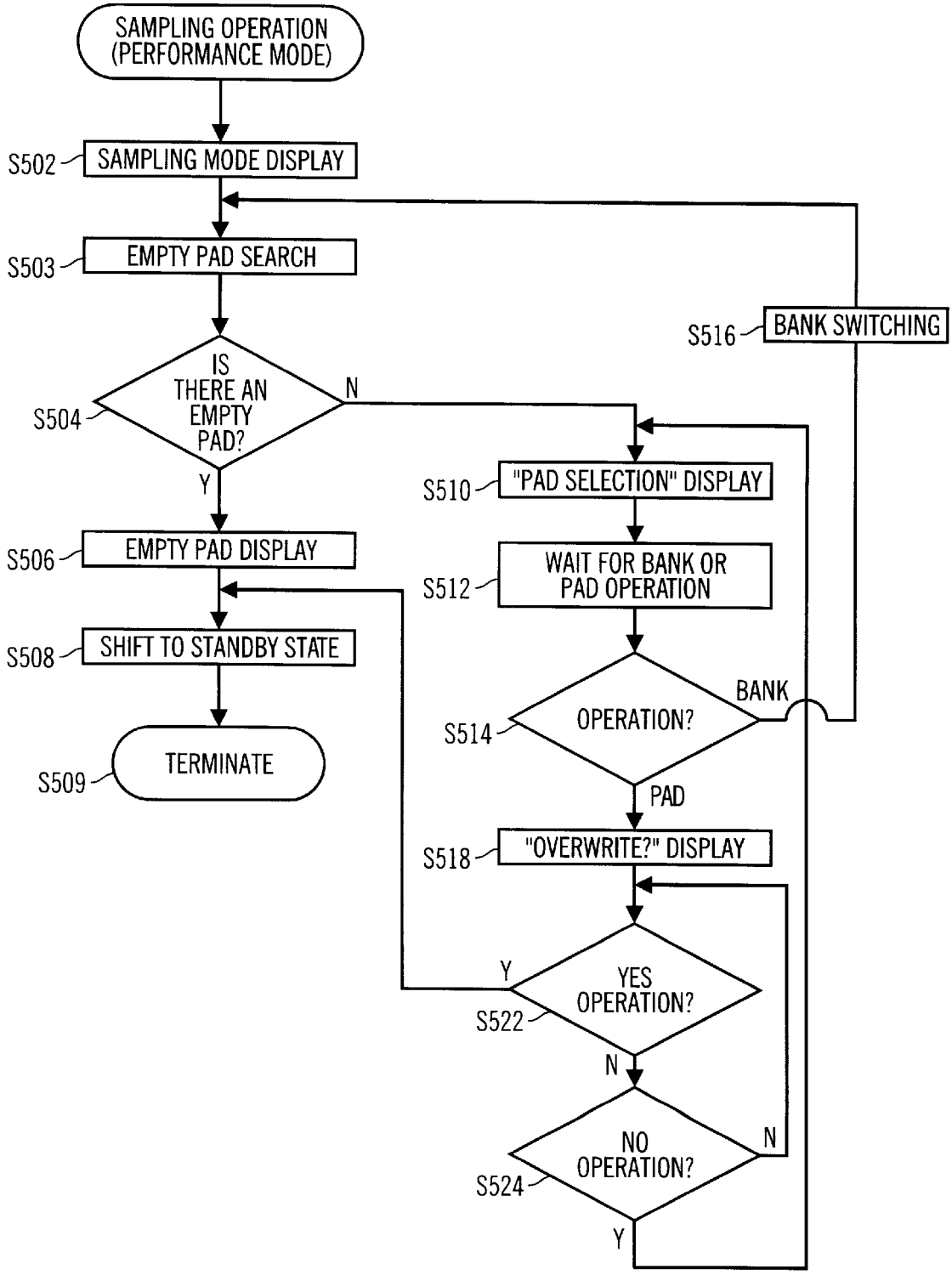
FIG. 5 depicts a sampling operation (performance mode) processing flow chart in accordance with a preferred embodiment.

FIG. 5 is a flow chart depicting a sampling operation in the performance mode according to an embodiment of the invention. When the sampling operator 36 operates in the performance mode, processing, such as shown in FIG. 5, is executed.

In the sampling operation (performance mode) processing flow chart, in Step S502, the sampling operator 36 is flashed together with the display of "sampling mode" on the upper area display screen 48*a* of the LCD 48, indicating that a shift to the sampling mode has been made.

When the Step S502 processing is complete, the procedure advances to Step S503, wherein the pad operator management map is referred to and an empty pad operator 30 to which waveform data have not been assigned is searched for in the bank having the bank number that corresponds to the current bank number. Next, in Step S504, a determination is made whether in Step S503 there was an empty pad operator 30 to which waveform data had not been assigned. In those cases in Step S504 where a determination is made that there were empty pad operators 30 to which waveform data had not been assigned, the pad operator 30 from among the empty pad operators 30 that has the lowest pad number is selected as the pad operator 30 to be assigned the waveform data. Once selected, that empty pad operator 30 is flashed (Step S506), a shift is made to the sampling standby state S508 from the performance mode and the sampling operation (performance mode) processing terminates S509.

In the state prior to the operation of the sampling operator 36, the pad operators 30 to which waveform data have been assigned in the current bank are lit. In addition, the pad operators 30 to which waveform data have not been assigned are extinguished and the pad operator 30 that is newly assigned the waveform data by the sampling operation (performance mode) processing is placed in a flashing state. The illumination state of the pad operators 30 allows the user to distinguish at a glance which of the pad operators 30 is in what state.

In those cases where, in Step S504, it has been determined that there are no empty pad operators 30 to which waveform data have not been assigned, "pad selection" is displayed on the lower area display screen 48*b* of the LCD 48. A suggestion is made to the user to select a pad operator 30 (Step S510). The display of the pad operator 30 is maintained until the pad operator 30 is chosen or a bank switching operator 34 is operated (Step S512).

In addition, in those cases where either the pad operator 30 is chosen or the bank switching operator 34 is operated, the process advances to Step S514, wherein a determination is made as to whether the pad operator 30 has been chosen or the bank switching operator 34 has been operated.

In those cases where, in Step S514, the operation of the bank switching operator 34 has been detected, the process advances to Step S516, wherein the display of "pad selection" on the lower area display screen 48*b* of the LCD 48 is erased and the bank is switched. The pad operator management map is referred to and, together with the illumination of the pad operators 30 to which the waveform data is assigned in the newly chosen bank, the empty pad operators 30 to which waveform data are not assigned is extinguished. The process then returns to Step S503 and a new search process is carried out in the bank for an empty pad operator 30 to which the waveform data is to be assigned.

In those cases where, in Step S514, the operation of the pad operator 30 has been detected, the pad operator 30 that has been operated is selected as the pad operator 30 that is assigned the waveform data. The contents of the display on the lower area display screen 48*b* of the LCD 48 are changed from "pad selection" to "overwrite?" and the pad operator 30 that has been operated is flashed (Step S518). The display of "overwrite?" is an inquiry to the user as to whether the waveform data that are already assigned to that pad operator 30 may be erased and a new assignment of waveform data made.

The process then advances to Step S522 and a determination is made as to whether the Yes operator 42 has been operated. In those cases where, in Step S522, it has been determined that the Yes operator 42 has been operated, the "pad selection" display is erased, the process shifts to the sampling standby state (Step S508) and this sampling operation (performance mode) processing terminates (Step S509).

In those cases where, in Step S522, it has not been determined that the Yes operator 42 has been operated, the process advances to Step S524 and a determination is made as to whether the No operator 44 has been operated. If it has been determined that the No operator 44 has been operated, the process returns to the "pad selection" display state of Step S510. In those cases where it has not been determined that the No operator 44 has been operated, the process returns to Step S522.

Although this is not shown in the figure, in those cases where the bank switching operator 34 has been operated after a shift to the sampling standby state S508, the selection state regarding the pad operator 30 that has been selected up to that point for the assignment of the waveform data is canceled and the process returns to the display state prior to the selection. The bank is switched in the same manner as in the processing mentioned above (Step S516) and it returns to the search process for an empty pad operator 30 for the assignment of waveform data (Step S503).

In the same manner, in those cases where the pad operator 30 has been operated following the shift to the sampling standby state S508, the selected state of the pad operator 30 that had, up to that point been selected for the waveform data assignment is canceled and processing is performed on the newly operated pad operator 30 to determine whether it is an empty pad. In those cases where the newly operated pad operator 30 is determined to be an empty pad, the processing advances to Step S506 and, in those cases where the newly operated pad operator 30 is not an empty pad, the processing advances to Step S510. In this case, because the waveform data assignment state of each pad operator 30 is displayed, the user can easily indicate pad operators 30 that have not yet had the waveform data assigned. In those cases where the sampling operator 36 has been operated in the performance mode, a pad operator 30 to which waveform data have not yet been assigned, in other words, an empty pad from within the current bank, is selected and this pad operator 30 becomes the new object of the assignment of waveform data.

In addition, in those cases where there is no empty pad operator 30 or, in those cases where the user desires to assign the waveform data to another pad operator 30 or to a pad operator 30 in another bank, it is possible to choose any pad operator 30 or any pad operator 30 desired in any bank for the assignment of waveform data. Then, the pad operator 30 that is the object of the waveform data assignment is put in a flashing state and the user can distinguish at a glance which of the pad operators 30 has been made the object of the assignment.

Figure 6:
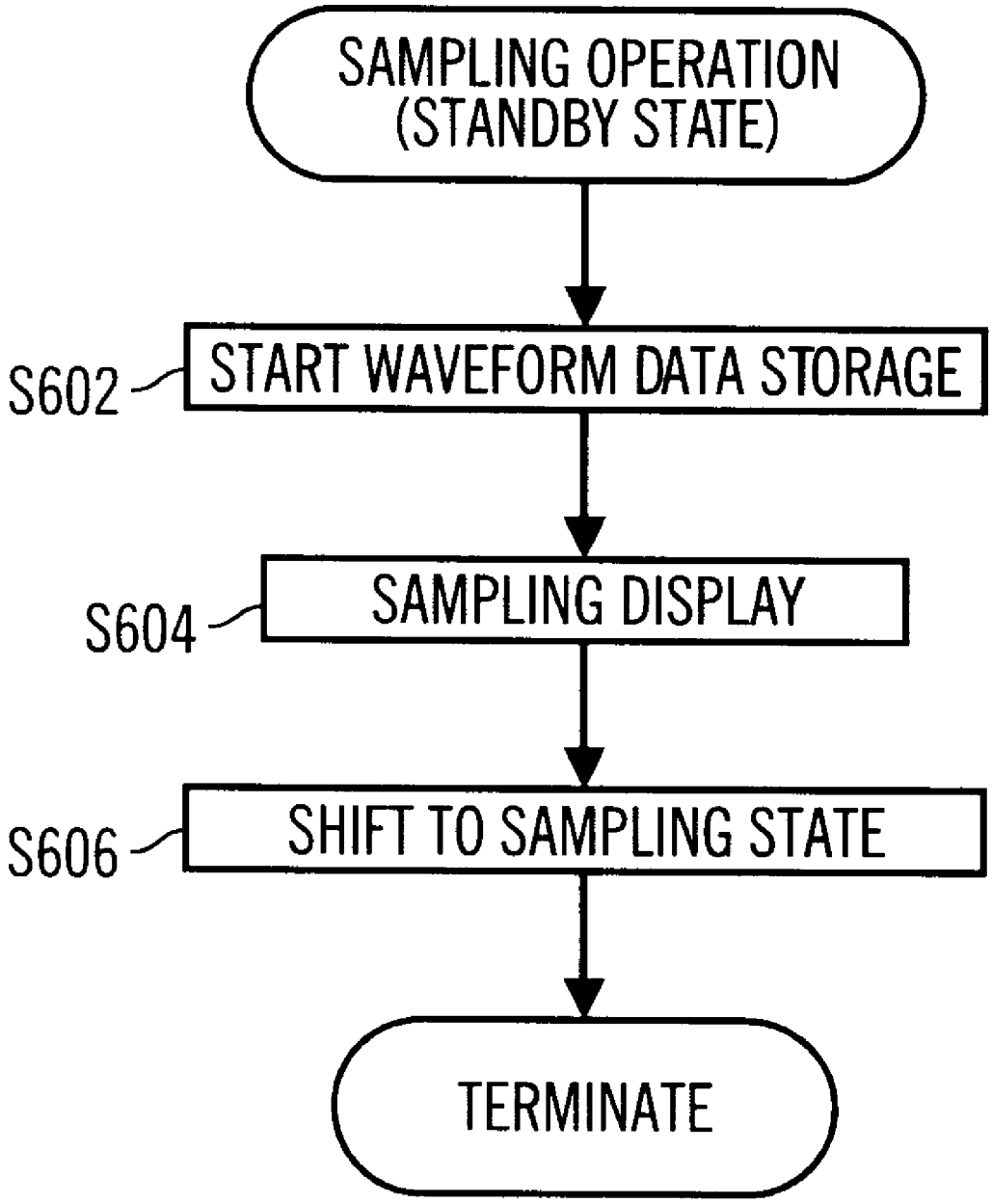
FIG. 6 depicts a sampling operation (standby state) processing flow chart in accordance with a preferred embodiment.

FIG. 6 depicts a preferred embodiment of a flow chart of a sampling operation in standby state. When the sampling operator 36 operates in the sampling standby state, a process, such as shown in FIG. 6, is executed.

In the sampling operation (standby state) processing flow chart, in Step S602, the storage of waveform data that are input externally is started. With Step S602 processing, the waveform data that are input by the process of each sampling cycle, which is not shown in the figure, are stored in the waveform data storage domain of the RAM 18.

When Step S602 has been completed, together with the display of "sampling" on the lower area display screen 48*b* of the LCD 48, the sampling pad operator 36 and the pad operator 30 that has been selected for the waveform data assignment are illuminated (Step S604). The process then shifts from the sampling standby state to the sampling state (Step S606) and the sampling operation (standby state) processing is completed. In other words, when the sampling operator 36 is operated in the sampling standby state, the sampling is started.

Figure 7:
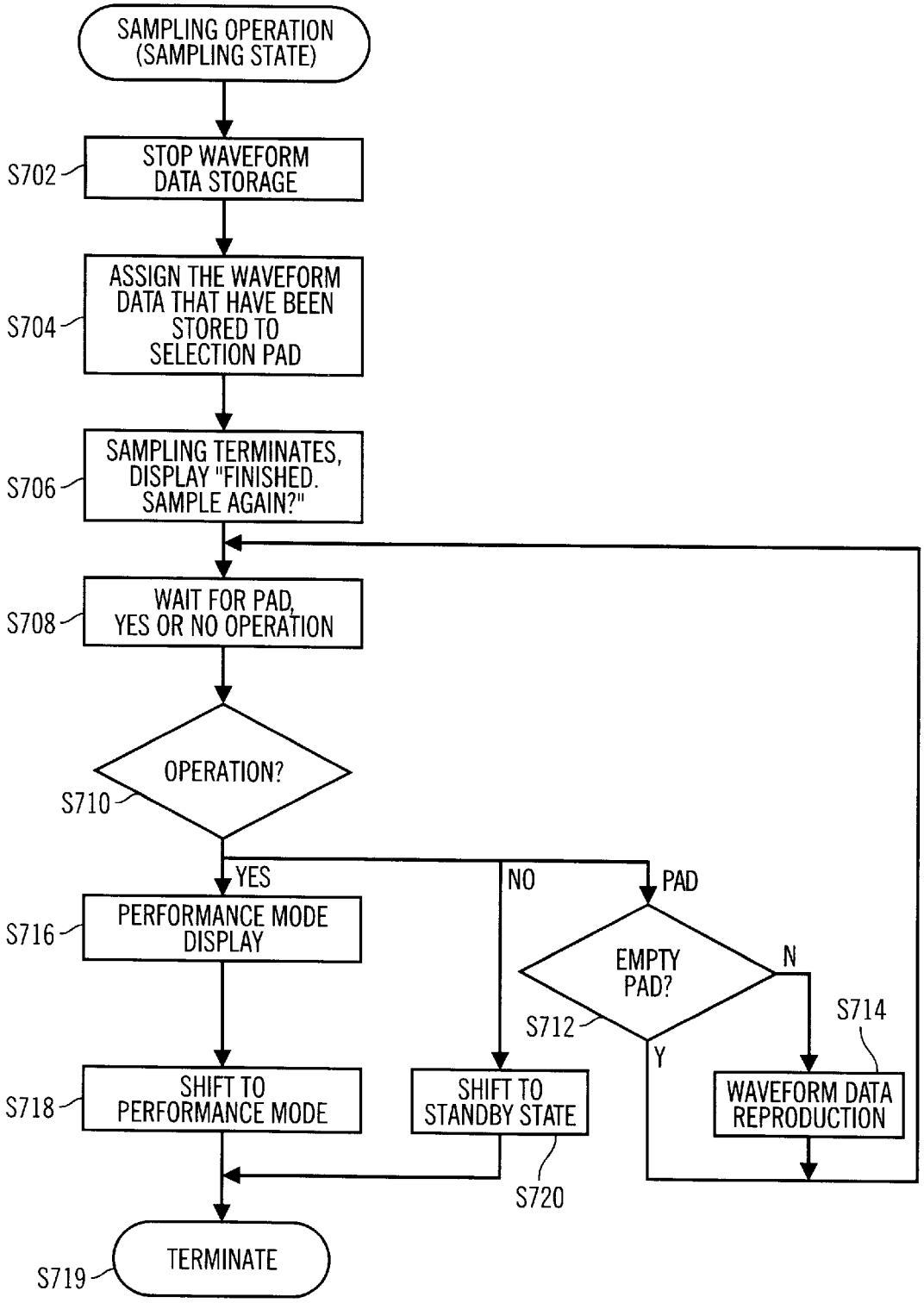
FIG. 7 depicts a sampling operation (sampling state) processing flow chart in accordance with a preferred embodiment.

FIG. 7 depicts a preferred embodiment of a flow chart of a sampling operation in the sampling state. When the sampling operator 36 operates in the sampling state, a process such as shown in FIG. 7 is executed.

In the sampling operation (sampling state) processing flow chart, in Step S702, the storage of waveform data is halted. When the processing of Step S702 is completed, the process advances to Step S704 and the waveform data that have been stored are assigned to the pad operator 30 that has been selected for assignment in the current bank. Specifically, information that indicates the location of the waveform data and the information that indicates the assignment of the waveform data are stored in the column of the pad operator management map for the current bank that corresponds to the pad operator 30 that has been selected as the object of the assignment.

When the processing of Step S704 has been completed, the contents of the display in the lower area display screen 48*b* of the LCD 48 changes to "completed. Sampling again?" (Step S706) and the process waits for the operation of any one of the pad operators 30, the Yes operator 42 or the No operator 44 (Step S708). Following that, the process advances to Step S710, and a determination is made of which of any one of the pad operators 30, the Yes operator 42 or the No operator 44 has been operated.

In those cases where it has been determined in Step S710 that a pad operator 30 has been operated, the process advances to Step S712 and a determination is made as to whether the pad operator 30 that has been operated is an empty pad operator 30 to which waveform data have not been assigned.

In those cases where the pad operator 30 that has been operated is not an empty pad operator 30 to which waveform data have not been assigned, that is, the pad operator 30 has waveform data assigned, the waveform data that have been assigned to the pad operator 30, which has been operated, are reproduced (Step S714). Once the waveform data are reproduced, the process returns to a waiting state (Step S708).

Accordingly, it is possible for the user, by means of operating the pad operator 30 to which the waveform data have been newly assigned after the completion of the sampling, to determine whether the waveform data that have now been stored are suitable.

Incidentally, because, it is possible to operate another pad operator 30, wherein the waveform data are also reproduced, it is possible to compare the waveform data that have been previously sampled with the new waveform data.

In addition, in those cases where, in Step S710, it has been determined that the Yes operator 42 has been operated, together with the display of "performance mode" on the upper level display screen of the LCD 48, the display on the lower area display screen 48*b* is erased (Step S716). The process then shifts to the performance mode (Step S718) and the sampling operation (sampling state) processing terminates.

In addition, in those cases where, in Step S710, it has been determined that the No operator 44 has been operated, the display on the lower area display screen 48*b* of the LCD 48 is erased, the process shifts to the sampling standby state (Step S720), and the sampling operation (sampling state) processing terminates S719.

In other words, when the sampling operator 36 is operated in the sampling state, the sampling halts, the waveform data that have been sampled are reproduced in response to the operation of the pad operator 30 and it is possible to carry out the sampling again in accordance with the operation of the No operator 44.

Figure 8:
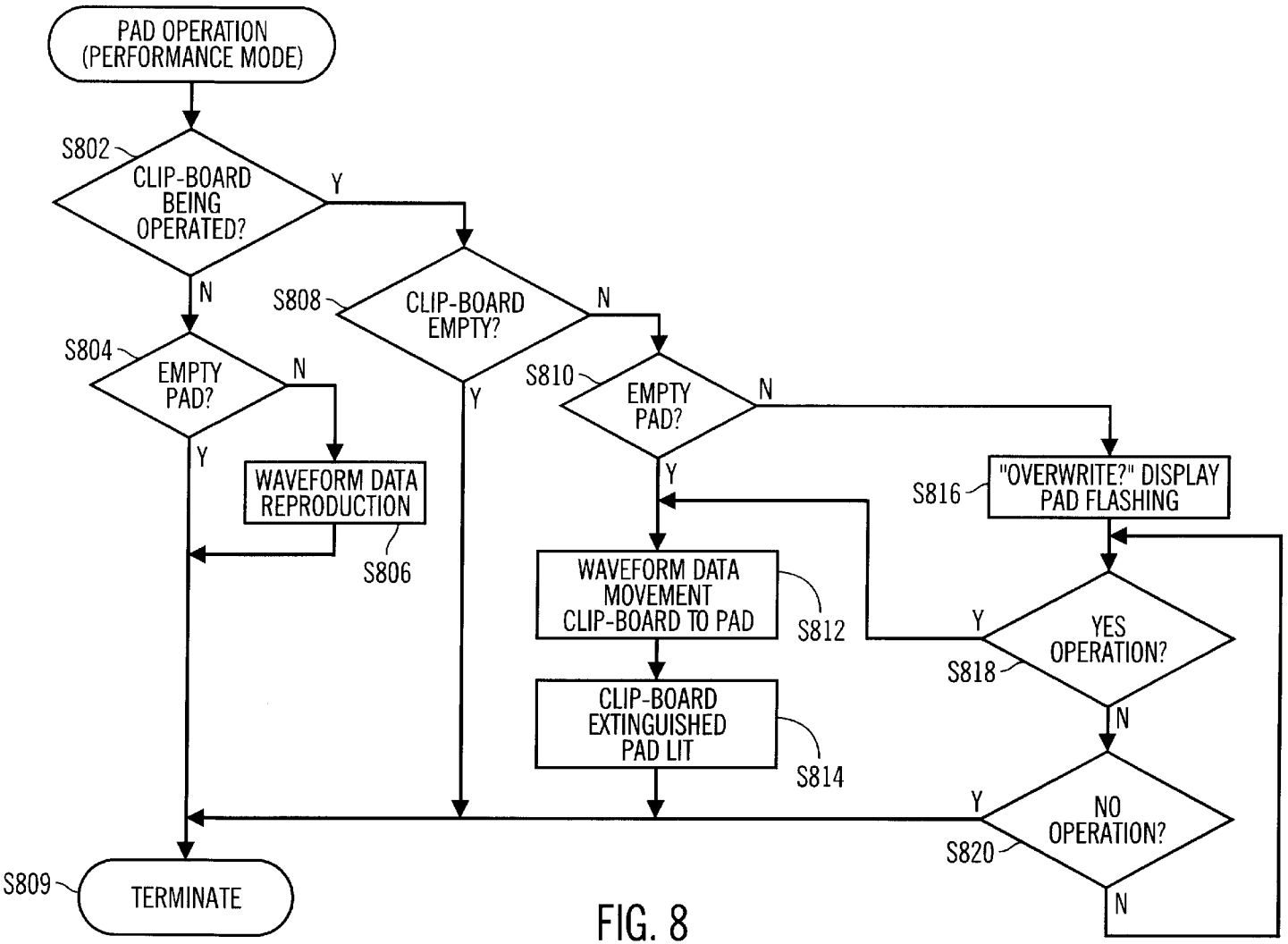
FIG. 8 depicts a pad operation (performance mode) processing flow chart in accordance with a preferred embodiment.

FIG. 8 depicts a preferred embodiment of a flow chart of a pad operation in performance mode. When the pad operator 30 operates in the performance mode, a process such as shown in FIG. 8 is executed.

In the pad operation (performance mode) processing flow chart, in Step S802, a determination is made as to whether the clip-board operator 32 is being operated. In those cases where, in Step S802, it has been determined that the clip-board operator 32 is not being operated, the process advances to Step S804 and a determination is made as to whether the pad operator 30 that has been operated is an empty pad operator 30 that does not have waveform data assigned in the current bank.

In those cases where, in Step S804, it has been determined that the pad operator 30 that has been operated is not an empty pad operator 30 that does not have waveform data assigned in the current bank, that is, in those cases where a pad operator 30 that has waveform data assigned in the current bank has been operated, the process advances to Step S806. The waveform data that have been assigned to the pad operator 30 are then reproduced and the pad operation (performance mode) process terminates S809.

In those cases where the clip-board operator 32 is in a state in which it has not been operated and a pad operator 30 that has waveform data assigned in the current bank is operated, the waveform data that have been assigned to the pad operator 30 that has been operated are reproduced. By means of this process, it becomes possible to carry out the performance using the pad operators 30. In contrast, in those cases where, in Step S804, it has been determined that the pad operator 30 that has been operated is an empty pad operator 30 that does not have waveform data assigned in the current bank, the pad operation (performance mode) process terminates.

In those cases where, in Step S802, it has been determined that the clip-board operator 32 is being operated, the process advances to Step S808, and a determination is made as to whether there are waveform data that have been assigned to the clip-board operator 32. In those cases where, in Step S808, it has been determined that waveform data have not been assigned to the clip-board operator 32, the pad operation (performance mode) process terminates.

On the other hand, in those cases where it has been determined that waveform data have been assigned to the clip-board operator 32, the process advances to Step S810 and a determination is made as to whether the pad operator 30 that has been operated is an empty pad operator 30 that does not have waveform data assigned in the current bank. In other words, in those cases where the clip-board operator 32 is in a state in which the waveform data have been assigned and the pad operator 30 has been operated while the clip-board operator 32 is operated, a determination is made as to whether waveform data have been assigned to the pad operator 30.

In those cases where, in Step S810, a determination has been made that the pad operator 30 that has been operated is an empty pad operator 30 to which waveform data have not been assigned, the process advances to Step S812 and the waveform data that have been assigned to the clip-board operator 32 are assigned to the pad operator 30 that has been operated in the current bank. Specifically, the information that indicates the storage location of the waveform data that have been assigned to the clip-board operator 32 and the information that indicates that waveform data have been assigned are recorded in the column in the pad operator management map that corresponds to the pad operator 30 that has been operated in the current bank. Further, the information that indicates that, for the clip-board operator 32, waveform data that have not been assigned, is recorded.

When the processing of Step S812 has been completed, the process advances to Step 814, wherein the clip-board operator 32 is extinguished, the pad operator 30 that has been operated is lit and the pad operation (performance mode) process terminates.

On the other hand, in those cases where, in Step S810, it has not been determined that the pad operator 30 that has been operated is an empty pad operator 30 to which waveform data have not been assigned in the current bank, together with the display of "overwrite?" on the lower area display screen 48*b* of the LCD 48, the pad operator 30 that has been operated is flashed (Step S816). The display of "overwrite?" is a question for the user as to whether it is acceptable to erase the waveform data that have previously been assigned to the pad operator 30 that has been operated and to assign new waveform data. Then, the process advances to Step S818 and a determination is made as to whether the Yes operator 42 has been operated.

In those cases where, in Step S818, it has been determined that the Yes operator 42 has been operated, the "overwrite?" display is erased. The process then advances to Step S812 and the waveform data that have been assigned to the clip-board operator 32 are assigned to the pad operator 30 that has been operated in the current bank.

On the other hand, in those cases where, in Step S818, it has not been determined that the Yes operator 42 has been operated, the process proceeds to Step S820 and a determination is made as to whether the No operator 44 has been operated. In those cases where, in Step S820, it has been determined that the No operator 44 has been operated, the "overwrite?" display is erased, the pad operator 30 that was previously in a flashing state in Step S816 returns to a lit state and the pad operation (performance mode) process terminates. On the other hand, in those cases where, in Step S820, it has not been determined that the No operator 44 has been operated, the process returns to Step S818.

Figure 9:
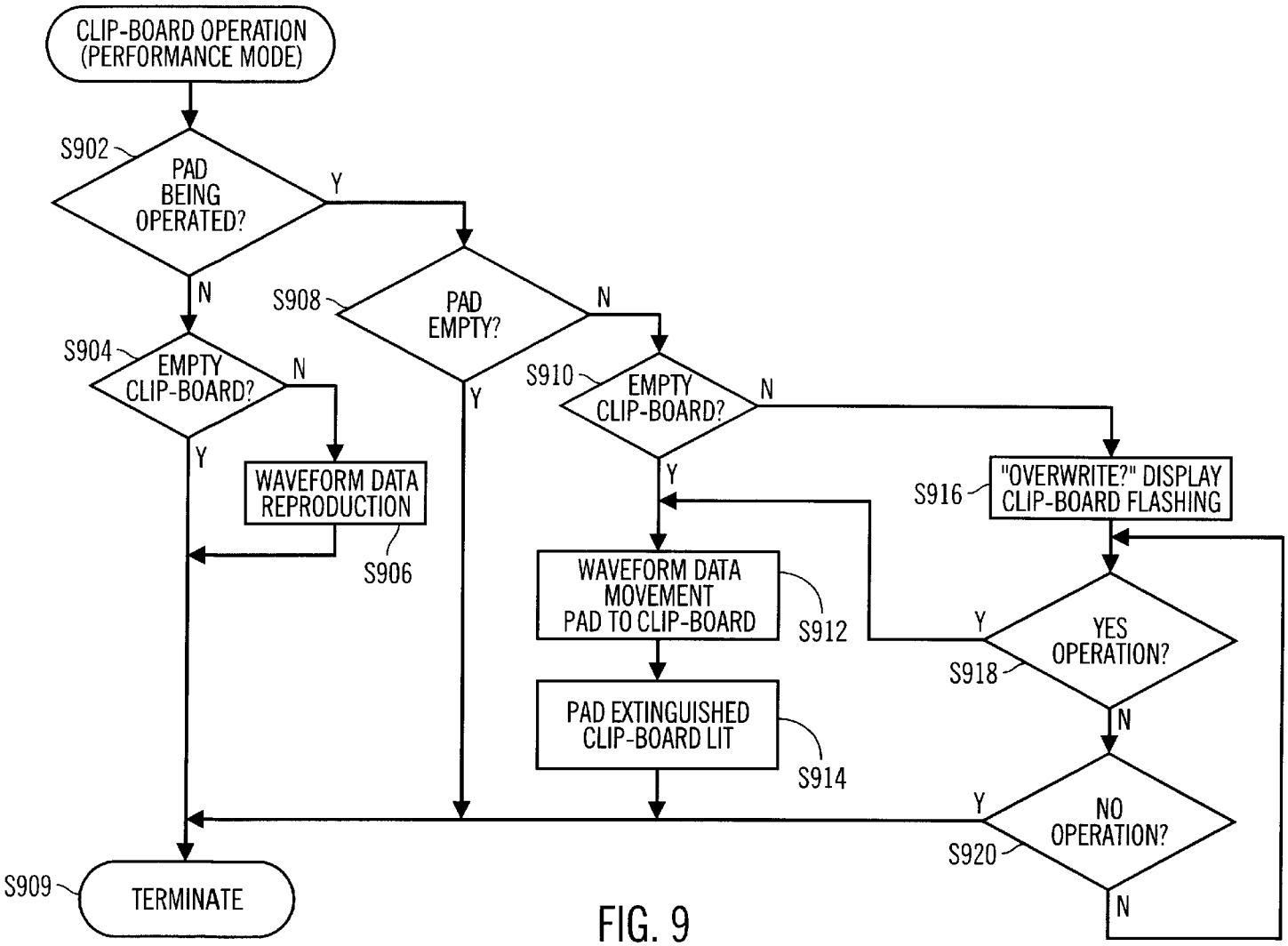
FIG. 9 depicts a clip-board operation (performance mode) processing flow chart in accordance with a preferred embodiment.

FIG. 9 depicts a preferred embodiment of a flow chart for a clip-board operation in the performance mode. When the clip-board operator 32 has been operated in the performance mode, a process such as shown in FIG. 9 is executed. The processing details of the clip-board operation (performance mode) process are the opposite of the processing details of the pad operation (performance mode) process that is shown in FIG. 8.

In the clip-board operation (performance mode) process flow chart, in Step S902, a determination is made as to whether a pad operator 30 has not been operated. In those cases where, in Step 902, it has been determined that a pad operator 30 has been operated, the process advances to Step 904 and a determination is made as to whether waveform data have been assigned to the clip-board operator 32.

In those cases where, in Step S904, it has been determined that waveform data have been assigned to the clip-board operator 32, the process advances to Step S906. The waveform data that have been assigned to the clip-board operator 32 are then reproduced and the clip-board operation (performance mode) process terminates S909.

In those cases where a pad operator 30 is in a state in which it has not been operated and the clip-board operator 32 to which waveform data have been assigned has been operated, the waveform data that have been assigned to the clip-board operator 32 are reproduced. By means of this process, it becomes possible for a performance to be carried out using the clip-board operator 32.

On the other hand, in those cases where, in Step S904, it has been determined that waveform data have not been assigned to the clip-board operator 32, the clip-board operation (performance mode) process terminates.

In addition, in those cases where, in Step S902, it has been determined that the pad operator 30 is being operated, the process advances to Step S908 and a determination is made as to whether the pad operator 30 that has been operated is an empty pad operator 30 to which waveform data have not been assigned in the current bank. In those cases where, in Step S908, it has been determined that the pad operator 30 that has been operated is an empty pad operator 30 to which waveform data have not been assigned in the current bank, the clip-board operation (performance mode) process terminates.

On the other hand, in those cases where, in Step S908, it has been determined that the pad operator 30 that has been operated is not an empty pad operator 30 to which waveform data have not been assigned in the current bank, the process advances to Step S910 and a determination is made as to whether the waveform data have been assigned to the clip-board operator 32. In other words, in those cases where waveform data have been assigned to the pad operator 30 that has been operated in the current bank and the clip-board operator 32 has been operated while the pad operator 30 is operated, a determination is made as to whether waveform data have been assigned to the clip-board operator 32.

In those cases where, in Step 910, it has been determined that waveform data have not been assigned to the clip-board operator 32, the process advances to Step S912 and the waveform data that have been assigned to the pad operator 30 that has been operated in the current bank are assigned to the clip-board operator 32. Specifically, the information that indicates the storage location of the waveform data that have been assigned to the pad operator 30, which has been operated, in the current bank and the information that indicates that the waveform data have been assigned are recorded for the clip-board operator 32. Further, the information that indicates that the waveform data have not been assigned is recorded in the column in the pad operator management map for the current bank that corresponds to the pad operator 30 that has been operated.

When the processing of Step S912 has been completed, the process advances to Step S914, the pad operator 30 that has been operated is extinguished, the clip-board operator 32 is illuminated and the clip-board operation (performance mode) process terminates.

On the other hand, in those cases where, in Step S910, it has been determined that waveform data have been assigned to the clip-board operator 32, together with the display of "overwrite?" in the lower area display screen of the LCD 48, the clip-board operator 32 is flashed (Step S916). The display of "overwrite?" is a question for the user as to whether the waveform data that have previously been assigned to the clip-board operator 32 may be erased and new waveform data assigned. The process then advances to Step S918 and a determination is made as to whether the Yes operator 42 has been operated.

In those cases where, in Step S918, it has been determined that the Yes operator 42 has been operated, the "overwrite?" display is erased, the process advances to Step S912 and the waveform data that have been assigned to the pad operator 30 that has been operated in the current bank are assigned to the clip-board operator 32.

On the other hand, in those cases where, in Step S918, it has not been determined that the Yes operator 42 has been operated, a determination is made as to whether the No operator 44 has been operated. In those cases where, in Step 920, it has been determined that the No operator 44 has been operated, the "overwrite?" display is erased and, in addition, the clip-board operator 32 that was put in a flashing state in Step S916 returns to a lit state and the clip-board operation (performance mode) process terminates. In those cases where, in Step S920, it has not been determined that the No operator 44 has been operated, the process returns to Step S918.

Accordingly, at those times when the waveform data that are assigned to a certain pad operator 30 are to be assigned to another pad operator 30, this function may be performed in accordance with the following procedures.

Procedure 1: With the original pad operator 30 having the waveform data that are to be transferred (the one that is lit) in its operated condition, the clip-board operator 32 is operated.

By means of the operation of Procedure 1, the waveform data that have been assigned to the pad operator 30 are transferred to the clip-board operator 32. At this time, the pad operator 30 is extinguished and the clip-board operator 32 is lit. This action indicates that this pad operator 30 is in a state in which waveform data are not assigned and the clip-board operator 32 is in a state in which waveform data are assigned. When the clip-board operator 32 is operated in this state, the waveform data that have been transferred to the clip-board operator 32 are reproduced.

When the clip-board operator 32 is lit and the operation of Procedure 1 is carried out with the clip-board operator 32 in a state in which some waveform data or other have previously been assigned, the message, "overwrite?" is displayed on the LCD 48 (the meaning of "overwrite?" is, "should the waveform data that are currently assigned to the clip-board operator 32 be erased and overwritten?") and the clip-board operator 32 flashes.

In those cases where they may be overwritten, the Yes operator 42 is operated. Then, in those cases where the Yes operator 42 has been operated, the waveform data are transferred from the pad operator 30 to the clip-board operator 32.

In those cases where it is not desired to overwrite, the No operator 44 is operated. Then, in those cases where the No operator 44 has been operated, the process is suspended and the transfer is not carried out.

Procedure 2: The pad operator 30 to which the waveform data are to be transferred is operated while the clip-board operator 32 is operated.

By means of the operation of this procedure, the waveform data that have been assigned to the clip-board operator 32 are transferred to the pad operator 30 that has been operated. At this time, the clip-board operator 32 is extinguished and the pad operator 30 that has been operated is lit. This action indicates that the clip-board operator 32 is in a state in which waveform data have not been assigned to it and the pad operator 30 that has been operated is in a state in which it has had waveform data assigned to it. When the pad operator 30 is operated in this state, the waveform data that have been assigned to this pad operator 30 are reproduced.

When the pad operator 30 is lit and the operation of Procedure 2 is carried out with the pad operator 30 in a state in which some waveform data or other have previously been assigned, the message, "overwrite?" is displayed on the LCD 48 (the meaning of "overwrite?" is, "should the waveform data that are currently assigned to the pad operator 30 be erased and overwritten?") and the pad operator 30 flashes.

In those cases where they may be overwritten, the Yes operator 42 is operated. Then, in those cases where the Yes operator 42 has been operated, the waveform data are transferred from the clip-board operator 32 to the pad operator 30.

In those cases where it is not desired to overwrite, the No operator 44 is operated. Then, in those cases where the No operator 44 has been operated, the process is suspended and the transfer is not performed.

The operations of the Procedure 1 and Procedure 2 may also be between different banks. In other words, the operation of said Procedure 1 is carried out when a certain bank has been selected and, following that, the banks are switched and the operation of Procedure 2 is performed. By means of this kind of operation, the waveform data that have been assigned to the pad operator 30 number 1 in a certain bank can be assigned to the pad operator 30 number 1 in another bank or, for example, to the pad operator 30 number 5.

In addition, by means of the use of said waveform data transfer function, it is possible to erase the waveform data that are assigned to any pad one desires. In other words, the clip-board operator 32 is operated while operating the pad operator 30 from which one wishes to erase the waveform data and this operation is repeated for the pad operators 30 from which it is desired to erase the waveform data. At this time, the pad operator 30 that has been operated is in a state in which it does not have waveform data assigned and is extinguished. The clip-board operator 32 is in a state in which the waveform data that had been assigned to the pad operator 30 which was last operated have been assigned to it and it is lit.

Figure 10:
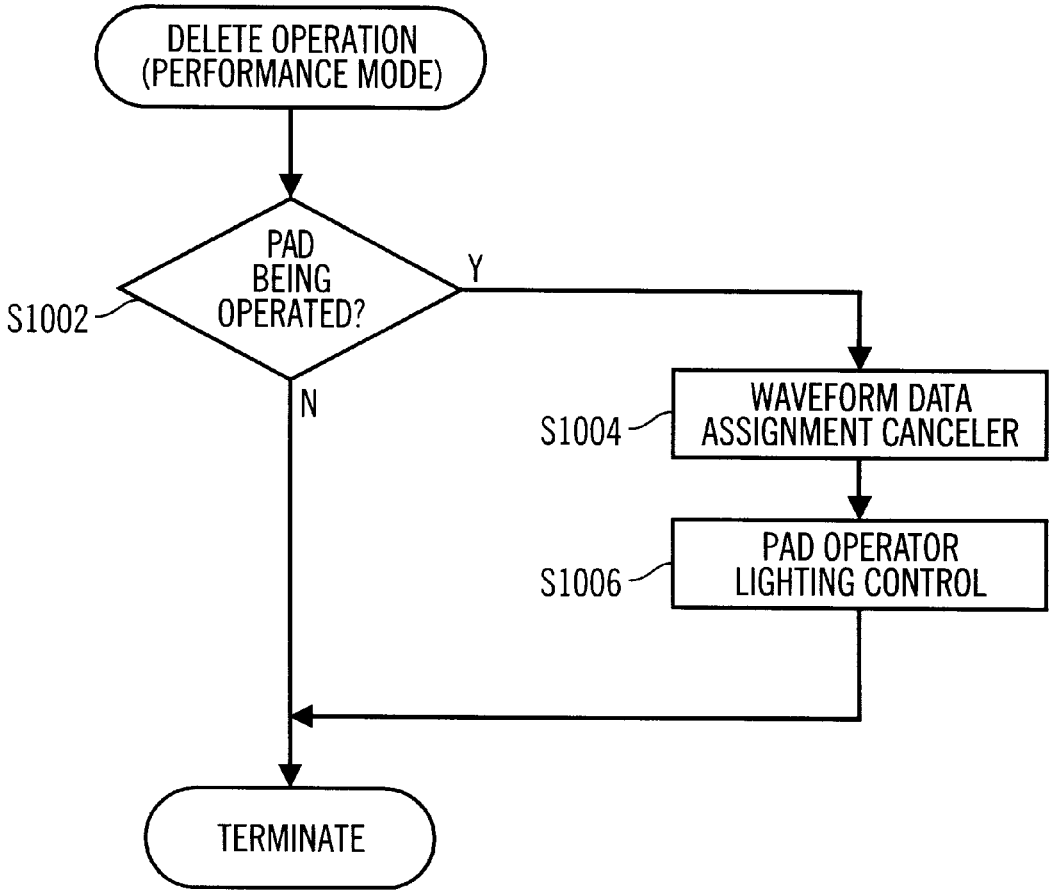
FIG. 10 depicts a delete operation (performance mode) processing flow chart in accordance with a preferred embodiment.

FIG. 10 depicts a preferred embodiment of a flow chart of a delete operation in performance mode. When the delete operator 38 has been operated in the performance mode, a process such as shown in FIG. 10 is executed.

In the delete operation (performance mode) processing flow chart, in Step S1002, a determination is made as to whether a pad operator 30 is being operated. In those cases where, in Step 1002, it has been determined that a pad operator 30 is being operated; namely, in those cases where the delete operator 38 has been operated while operating a pad operator 30, the process advances to Step 1004 and the assignment of the waveform data that are assigned to the pad operator 30 that is being operated in the current bank is canceled. Specifically, the information that indicates that waveform data are not assigned is recorded in the column in the pad operator management map for the current bank that corresponds to the pad operator 30 that is being operated.

At this time, the waveform data that was assigned to the pad operator 30 that is being operated may be erased and the non-stored portion of the waveform data storage region made larger. Or, when the delete operator 38 has been operated, only the column in the pad operator management map that indicates whether waveform data have been assigned is rewritten. By the designation of a specified operation, the waveform data that had been previously assigned to the pad operators 30 for which information that indicates that waveform data are not assigned is recorded in the pad operator management map may be erased together.

When the processing of Step S1004 has been completed, the process advances to Step S1006 and together with the lighting of the pad operator 30 to which the waveform data are assigned in the current bank based on the changed storage contents of the pad operator management map, the pad operator 30 to which waveform data are not assigned in the current bank is extinguished and the delete operation (performance mode) processing terminates. On the other hand, in those cases where, in Step S1002, a determination has been made that a pad operator 30 is not being operated, the delete operation (performance mode) processing terminates.

Figure 11:
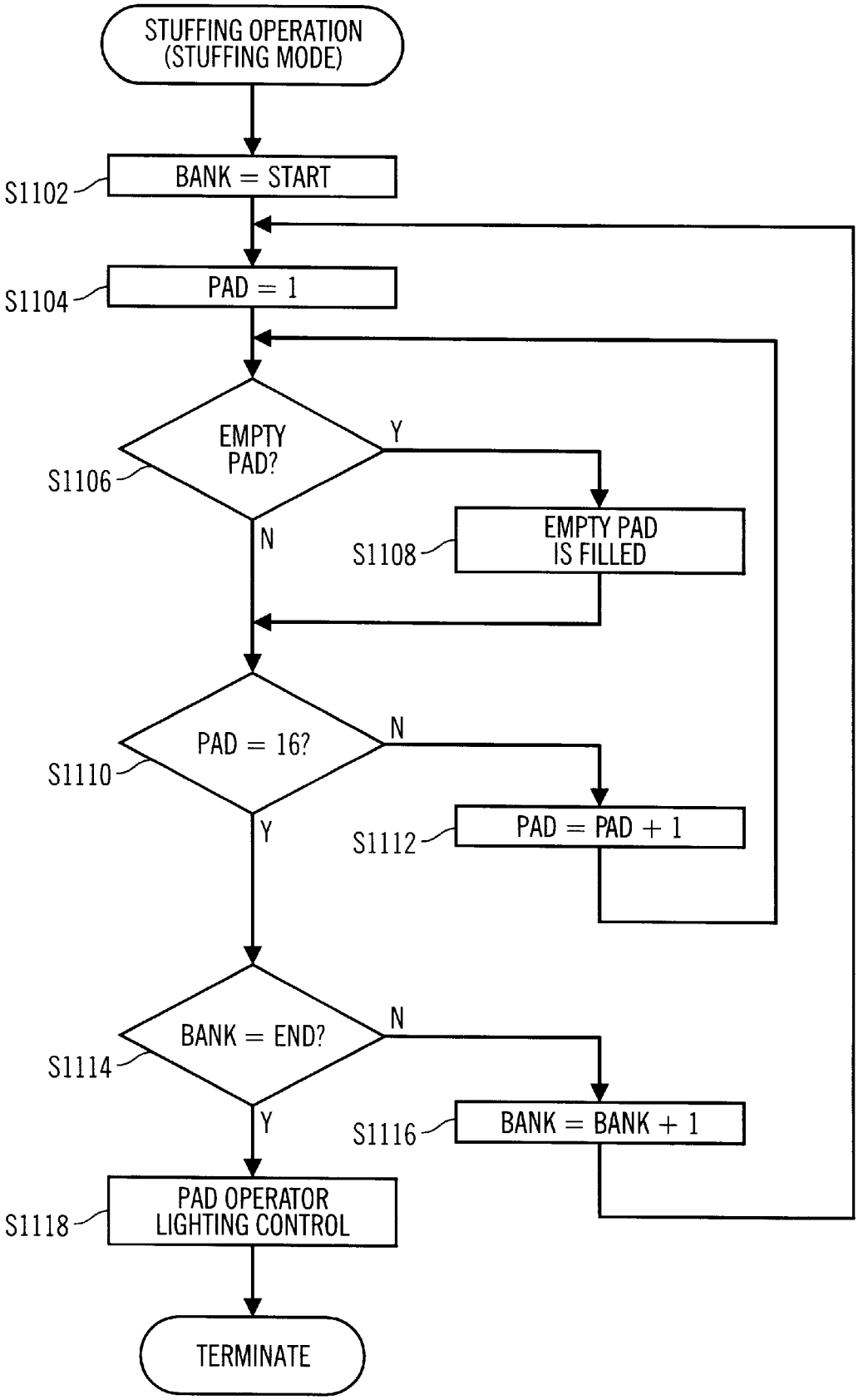
FIG. 11 depicts a stuffing operation (stuffing mode) processing flow chart in accordance with a preferred embodiment.

FIG. 11 depicts a preferred embodiment of a stuffing operation in stuffing mode. When the stuffing operator 40 has been operated in the performance mode, the process changes to the stuffing mode and the setting screen for the range of banks in which the reassignment of waveform data to the pad operators 30 can be carried out (start bank and end bank) is displayed. With this screen, "stuffing mode" is displayed on the upper area display screen 48*a* of the LCD 48 and "start bank:end bank" is displayed on the lower area display screen 48*b*. The bank number of the start bank is input by the initial operation of the ten-key pad 46 and the bank number of the end bank is input by the next operation. When the stuffing operator 40 is operated again, a stuffing operation (stuffing mode) processing is performed.

In the stuffing operation (stuffing mode) processing, the bank number "bank" is set to "start" which is the bank number of the start bank that has been set by the ten-key pad 46 (Step S1102) and the pad number "pad" is set to "1" (Step S1104). After that, the process advances to Step S1106, the pad operator management map is referred to and a determination is made as to whether the pad operator 30 having the pad number "pad" of the bank having the bank number "bank" has waveform data assigned to it, that is, whether it is an empty pad.

In those cases where, in Step S1106, it is determined that waveform data have not been assigned to the pad operator 30 having the pad number "pad" of the bank having the bank number "bank," the process advances to Step S1108. The stored contents of the pad operator management map for pad operators 30 that have pad numbers greater than "pad" in the bank having the bank number "bank" are transferred to the domain for the pad operator 30, wherein the pad number of which is smaller by 1. Following this, the stored contents of the pad operator management map for the pad operator 30 having the pad number 1 of the bank having a bank number that is greater by 1 than the bank number "bank" are transferred to the domain of the pad operator having the pad number 16 of the bank number "bank" and the stored contents of the pad operator management map in the bank having a bank number that is larger by 1 than the bank number "bank" are transferred to the domain of the pad operators that have pad numbers that are smaller by 1. After this, the same process is repeated up to the end bank.

With regard to the pad operator 30 having the pad number 16 in the end bank, because there are no stored contents in the pad operator management map that should be transferred, information that indicates that there are no waveform data assigned is stored in the pad operator management map.

The same kind of processing is repeated until the pad number "pad" reaches "16." In other words, until the processing for the pad operator 16 having a pad number of 16 is reached, the process is repeated while incrementing the pad number pad in steps of "1" (Step S1110 to Step S1112 to Step S1104).

When the processing for the pad operator having a pad number of 16 has been completed, the process advances to Step S1106 and the process is repeated until the bank number "bank" reaches the end bank number "end." In other words, the process is repeated while incrementing the bank number "bank" in steps of "1" until the end bank is processed (Step S1114 to Step S1116 to Step S1104).

When the processing for the end bank has been completed, the process advances to Step S1118 and, together with the lighting of the pad operator 30 to which the waveform data have been assigned in the current bank based on the stored contents of the pad operator management map that have been changed, the pad operator 30 to which waveform data are not assigned in the current bank is extinguished and the stuffing operation (stuffing mode) processing terminates.

Accordingly, by means of said stuffing operation (stuffing mode) processing, the pad operators 30 to which waveform data are assigned are filled up and sorted in order toward the smaller of the pad numbers and toward the smaller of the bank numbers.

When with the use of the clip-board operator 32 and the delete operator 38, pad operators 30 to which waveform data are not assigned are randomly positioned in various banks, confusion exists at the time of performance. Specifically, in the case in which for a bank having the bank number 1, waveform data are only assigned to pad operators 30 having, the pad number 1, the pad number 3, the pad number 7, the pad number 14, the pad number 15 and the pad number 16 due to random assignment of waveform data to the pad numbers 30, there is confusion at the time of performance.

However, by means of said stuffing operation (stuffing mode) processing, a reassignment of the waveform data is carried out so that the waveform data that are assigned to each of these pad operators 30, that is, the pad number 1, the pad number 3, the pad number 7, the pad number 14, the pad number 15 and the pad number 16 are assigned successively to the pad operators 30 having the pad numbers 1–7 and, due to the reassignment, it becomes easy to conduct the performance.

In addition, in a case where the waveform data are assigned only to five of the pad operators 30 in the bank having the bank number 1 and waveform data are only assigned to seven of the pad operators 30 in the bank having the bank number 2, when conducting a performance in which the waveform data that have been assigned to these two banks are used, it is necessary to carry out bank switching and the performance operation becomes extraordinarily troublesome.

However, if, by means of said stuffing operation (stuffing mode) processing, this total of 12 groups of waveform data are collected together in the bank having the bank number 1, it is possible to conduct a performance without carrying out bank switching and the performance operation becomes extremely simple. In addition, in this case, because the bank having the bank number 2 becomes one in which all of the empty pad operators 30 are ones that have no waveform data assigned, it is possible to sample and assign new waveform data here and the arrangement of the waveform data becomes simple.

Figure 12:
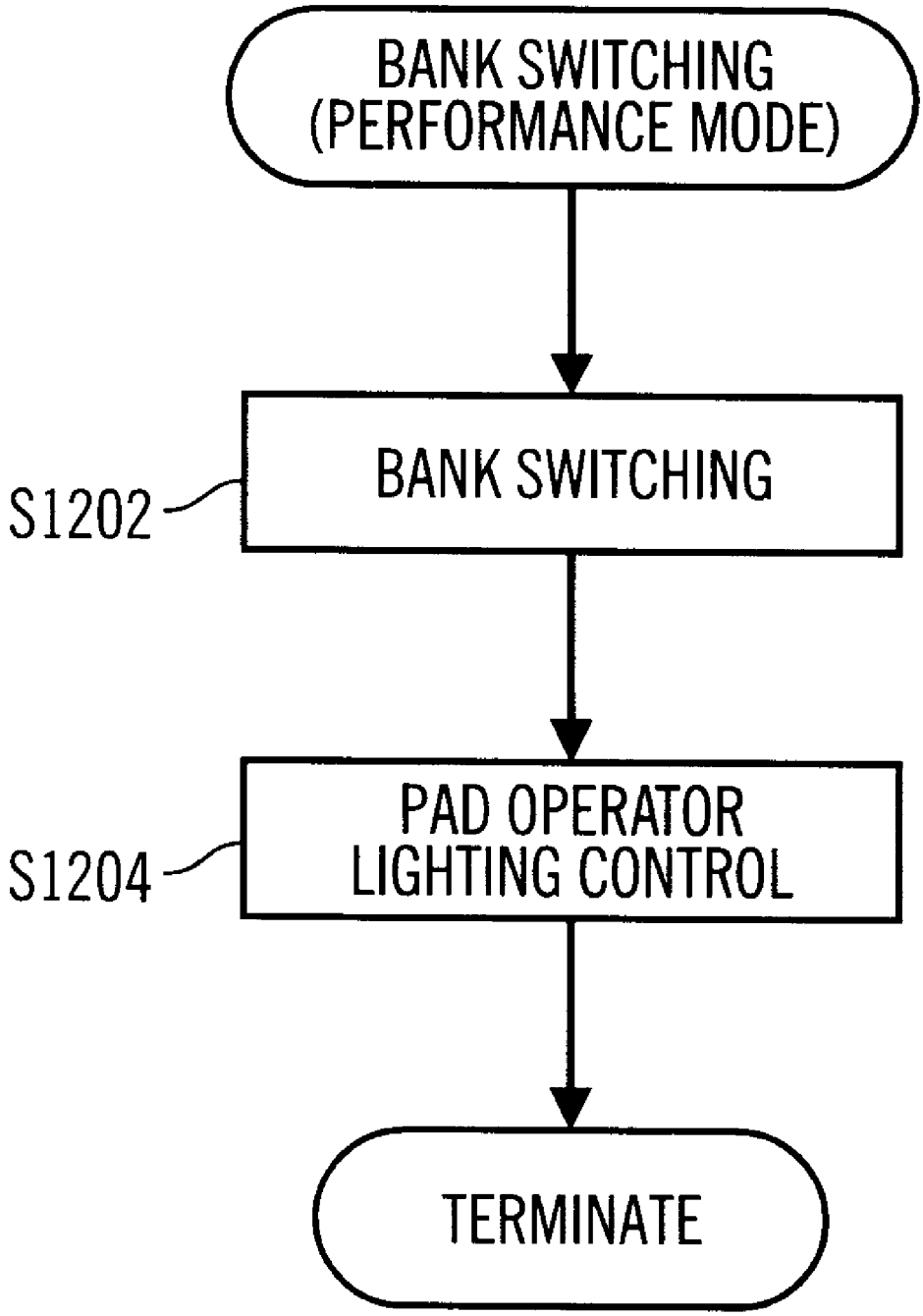
FIG. 12 depicts a bank switching operation (performance mode) processing flow chart in accordance with a preferred embodiment.

FIG. 12 depicts a preferred embodiment of a bank switching operator 34 which has been operated in the performance mode. When the bank switching operator 34 has been operated in the performance mode, a processing such as shown in the bank switching (performance mode processing flow chart of FIG. 12 is executed.

With reference to FIG. 12, in Step S1202 of the bank switching (performance mode) processing flow chart, the bank is switched in response to the operation of the bank switching operator 34. By means of this, waveform data are assigned to each of the pad operators 30 that correspond to the new bank.

When the processing of Step S1202 has been completed, the process advances to Step 1204 and, together with the lighting of the pad operators 30 to which waveform data have been assigned in the new bank, the pad operators 30 to which waveform data are not assigned in the new bank are extinguished and the bank switching (performance mode) processing terminates.

By this means, for each pad operator 30, there is a display that conforms to the state of waveform data assignment and the user can distinguish at a glance which of the pads have waveform data assigned.

Other preferred embodiments of the instant invention include modifications of the embodiment described above.

(1) In the aforementioned embodiment, in those cases where the waveform data are transferred from the clip-board operator 32 to a pad operator 30, the clip-board operator 32 takes a state in which waveform data are not assigned. However, in other preferred embodiments, the waveform data may remain in the clip-board operator 32. In addition, in those cases where the waveform data are transferred from a pad operator 30 to the clip-board operator 32, a mode may be established in which the waveform data may remain in the pad operator 30. In this manner, it is possible to easily assign one waveform data to a plurality of pad operators 30.

(2) In the aforementioned embodiment, the waveform data are assigned from only one pad operator 30, that is, from only one pad operator 30 to the clip-board operator 32. However, in another preferred embodiment, it is also possible to assign pluralities of waveform data to a plurality of pad operators 30. In this case, classification codes such as names or numbers are assigned to the plurality of waveform data, the classification codes are displayed and any of the waveform data from among them are selected as desired. The waveform data that have been selected are reproduced in response to the operation of the clip-board operator 32 or the waveform data that have been selected are transferred from the clip-board operator 32 to the pad operator 30.

(3) In the aforementioned embodiments, only the waveform data are assigned to the pad operators 30. However, in further preferred embodiments, in addition to waveform data, musical tone control parameters that regulate the musical tones generated by the reproduction of the appropriate waveform data may also be assigned. Or, musical tone control parameters that regulate musical tones to be generated may be assigned, without the assignment of waveform data.

(4) In the aforementioned embodiment, in those cases where the stuffing operation (stuffing mode) process is executed by the operation of the stuffing operator 40, the processing is carried out together for the range of banks that have been specified for the stuffing process (such that the waveform data that are in a later bank are moved to the previous bank). However, in other preferred embodiments, a mode may be established in which the stuffing process is independently performed within each bank.

(5) In the aforementioned embodiment, each of the pad operators 30 have been made self-illuminating. However, in some preferred embodiments, as long as the state in which waveform data are assigned can be displayed for each pad operator 30, than any manner of displaying that waveform data are assigned is suitable, including, but not limited to, a separate display device associated with each pad operator 30 in the vicinity of the associated pad operator 30.

(6) In the aforementioned embodiment, rather than the waveform data themselves, the waveform data storage location is recorded as a pointer that indicates the waveform data in the storage domain of the pad operator management map and for the clip-board operator 32. However, in other preferred embodiments, the waveform data themselves are stored.

(7) In some preferred embodiments, the stuffing operation (stuffing mode) process is carried out by a processing method other than that shown in the aforementioned embodiment. A description of other preferred embodiments will be given below concerning processing methods other than those given in the aforementioned embodiment.

First, an explanation will be given regarding a preferred embodiments of a processing method. In this processing method, a working map is established in advance that is configured the same as for one bank of the pad operator management map that is shown in FIG. 3. Then with regard to the first bank with which the reassignment of waveform data to the pad operators 30 is performed, a determination is made as to whether waveform data have been assigned to the first pad operator 30 (no. 1). If there are waveform data assigned, after the contents of the pad operator management map for that pad operator 30 are copied to the region for the first pad operator 30 (no. 1) of the work map, the same determination is made for the next (no. 2) pad operator 30. If there are no waveform data assigned to the first (no. 1) pad operator 30, the determination is made for the next (no. 2) pad operator 30 without performing the copying.

If waveform data have been assigned to the next (no. 2) pad operator 30, the contents of the pad operator management map for that pad operator 30 are copied to the region of the work map for the first pad operator 30 from among the pad operators 30 that have not yet been copied. For example, if copying has been carried out for pad operator 30 no. 1, it is the region for pad operator 30 no. 2 and, if copying has not been carried out for pad operator 30 no. 1, it is the region for pad operator 30 no. 1. Then the same determination is made again for the next (no. 3) pad operator 30. If there are no waveform data assigned to the next (no. 2) pad operator 30, the determination is made for the next (no. 3) pad operator 30 without carrying out said copying. The type of processing as that described above is repeated for the rest of the pad operators 30: namely pad numbers 3–16.

When this processing is repeated and the process has been completed for the first bank, the same process is carried out for the next bank. Then, when the copying has been accomplished for all of the pad operators 30 regions of the work map, the contents of the work map are copied to the region of the pad operator management map for the first bank that has a reassignment carried out.

Following this, the same process is carried out for the pad operator 30 that follows the pad operator 30 for which said processing has been carried out. Again, when the copying has been accomplished for all of the pad operator 30 regions of the work map, copying is next done to the region of the pad operator management map for the bank that follows the bank for which copying has been done up to that point (in this explanation, it is the bank that follows the first bank).

After this, the same process is repeated and, when the processing has been completed for the last bank to which reassignment is to be carried out, the contents of the work map at that point in time are copied to the region of the pad operator management map for the bank that follows the bank for which copying has been done up to that point. The regions of the pad operator management map for the pad operators 30 in the area from the first bank to the last bank for which reassignment is to be carried out and which have not yet been copied from the work map are cleared and the condition is indicated for the pad operators 30 of those regions that waveform data have not been assigned. Even if the work map is made larger than one bank, it is possible to carry out the same kind of processing.

In addition, an explanation will be given concerning another preferred embodiment of the processing method. In this processing method, pad operators 30 that have waveform data assigned are searched for in order from the smallest pad number from the first pad operator 30 of the first bank for which reassignment is to be carried out. At the point in time where a pad operator 30 that has waveform data assigned is found, the stored contents of the pad operator management map for that pad operator 30 are copied to the region of the pad operator management map for the first pad operator 30 of the first bank for which there is to be reassignment.

Next, the same kind of search is carried out for the pad operator that has the pad number following that of the pad operator 30 that was just found. At the point in time where a pad operator 30 is found that has waveform data assigned, the contents of the pad operator management map for that pad operator 30 are copied to the region of the pad operator management map for the next pad operator 30 (in this explanation, it is the second) of the first bank for which reassignment is to be carried out.

After this, in the same manner, the processing is carried out in order with the next pad operator 30 and then with the next pad operator 30. When the processing has been completed for the pad operator 30 of the first bank, the same processing is carried out for the pad operator 30 of the next bank. When the copying is done in this manner to the regions of the pad operator management map for all of the pad operators 30 of the first bank, the copying is done to the regions for the pad operators 30 of the next bank.

The same processing is repeated until the final pad operator 30 of the last bank for which reassignment is to be carried out. Finally, the stored contents of the regions of the pad operator management map for which copying has not yet been done in the range from the first pad operator 30 of the first bank for which reassignment is to be carried out until the last pad operator 30 of the last bank are cleared and the condition that waveform data have not been assigned to the those pad operators 30 of those regions is indicated.

It is possible to employ various other processing methods in addition to those that have been described above. Indeed, any processing method is suitable wherein the waveform data that are to be assigned to each of the pad operators 30 in each of the banks, which are the objects of the reassignments, be able to be reassigned in accordance with the bank order as well as the order of the pad operators 30 to which the waveform data are assigned, wherein the order is from the first pad operator 30 to the last pad operator 30 of the first bank that is the object of the reassignment and, in addition, from the first pad operators 30 to the last pad operators 30 in the following banks that are the objects of the reassignment. If this can be done, any processing method may be used as a matter of course.

(8) In the aforementioned embodiment, it is set up so that the bank to which the stuffing process is to be carried out is designated. However, in some preferred embodiments, the stuffing process is performed for all of the banks as a batch.

(9) In the aforementioned embodiment, when the bank to which the stuffing process is to be performed is designated, a specified range of banks is designated by designating the starting bank and the ending bank. However, in other preferred embodiments, the banks to which the stuffing process is to be performed is individually designated.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. An electronic musical instrument having a plurality of first operators, each of which is capable of being assigned a musical tone, and being operated to start a reproduction of the assigned musical tones, the instrument comprising:

a first control means for selecting at least one first operator from among said plurality of first operators in response to a stimulus from a user, and with a cancellation of the assignment to said at least one first operator that has been selected of the musical tone that had previously been assigned to said selected first operator, for storing the musical tone that had previously been assigned to said selected first operator; and a second control means for selecting at least one other first operator from among said plurality of operators in response to the stimulus from a user, and for assigning the musical tones which have been stored in said first control means to the at least one other selected first operator.

2. For the electronic musical instrument cited in claim 1, the electronic musical instrument, wherein for the patterns of musical tones that are assigned to said first operator, a plurality of varieties are established and it is possible to select any of the assigned patterns and, in said second control means, the musical tones in any of the assigned patterns, the assignments of which were canceled by said first control means, are assigned to the first operator which is selected from among the plurality of first operators in another pattern.

3. An electronic musical instrument comprising:

a plurality of first operators, each being assigned a musical tone;

a second operator to which a musical tone is temporarily assigned;

a first control means with which any of the first operators are selected from among said plurality of first operators in response to a stimulus from a user, and together with a cancellation of the assignment to said first operators that have been selected of the musical tones that had previously been assigned to said selected first operators, the musical tones that had previously been assigned to said selected first operators are assigned to said second operator; and a second control means for selecting the first operator from among said plurality of first operators in response to a stimulus from the user, and for assigning the musical tones that have been assigned to said second operators by said first control means.

4. For the electronic musical instrument cited in claim 3, wherein said second operator carries out the designation of the start of the reproduction of the musical tones that have been assigned in conformance with their operation.

5. For the electronic musical instrument cited in claim 3 wherein in said second control means, the musical tones that have been assigned to said second operators by said first control means are assigned to any of the first operators from among said plurality of first operators which have been selected and assignment to said second operator of the musical tones that have been assigned to said second operator is canceled.

6. For the electronic musical instrument cited in claim 5, the electronic musical instrument further comprising:

a display means in which, together with the display of whether or not each of the musical tones has been assigned to said plurality of first operators, whether or not the musical tones have been assigned to said second operators is displayed.

7. An electronic musical instrument having a plurality of operators which can be mapped to musical tones such that a state of musical tone mapping is established, the production of the musical tones that are mapped are conducted in accordance with the operation of the operators, comprising:

a management information storage means for storing management information wherein the management information indicates the state of the musical tone mapping for each of the plurality of operators;

a change direction means for changing the state of the musical tone mapping for each of the plurality of operators in response to a stimulus from a user;

a change means in which the management information is changed in accordance with the changes that have been implemented by the change direction means;

display devices, wherein each display device corresponds to each of the plurality of operators; and a display control means for controlling the display devices;

wherein the control of the display devices is based on the management information that has been stored in the management information storage means, wherein the state of the musical tone mapping for each of the plurality of operators is displayed in the display devices.

8. An electronic musical instrument as claimed in claim 7, the electronic musical instrument further comprising:

a plurality of patterns for assigning the musical tone to the operators, wherein the patterns of musical tone mapping to the plurality of operators are established in a plurality of varieties; and wherein the management information that is stored in the said management information storage means includes information that indicates the state of the musical tone mapping for each of the plurality of operators in each of the plurality of patterns and a specific pattern that is currently selected from among the plurality of patterns;

wherein changing the state of the musical tone mapping by the change direction means includes selecting a pattern;

wherein the change means rewrites the information that indicates the pattern from among the plurality of patterns that is currently selected; and wherein the display control means based on the information that indicates the pattern from among the plurality of patterns that has been selected, refers to the information that indicates the state of the musical tone mapping for each of the plurality of operators in the pattern that has currently been selected and controls the display devices.

9. An electronic musical instrument as claimed in claim 7, the electronic musical instrument further comprises:

a musical tone input means for inputting new musical tones;

wherein the change direction means selects an operator in the plurality of operators for mapping the musical tones that are input by the musical tone input means; and wherein the change means is configured for rewriting the management information for the operator that has been selected.

10. An electronic musical instrument as claimed in claim 9, wherein the display control means controls the display devices in a manner in which a first display mode which is concerned with the operators from among the said plurality of operators to which the musical tones are mapped and a second display mode which is concerned with the operators from among the plurality of operators to which the musical tones are not mapped and a third display mode which is concerned with the operator from among the plurality of operators to which the musical tone that has been input by the said musical tone input means are mapped.

11. An electronic musical instrument as claimed in claim 7, wherein the change direction means, in response to a stimulus from the user, selects the first operator to which the musical tone is mapped from among said plurality of operators and the second operator that is other than the first operator from among said plurality of operators, and, together with the cancellation of the mapping relationship between said first operator and the musical tone that is mapped to said first operator, changes the mapping of the musical tone the correspondence relationship to said first operator of which has been canceled to the second operator; and the change means is one in which the management information that indicate the state of the mapping of the musical tones to said first operator and second operator are rewritten.

12. An electronic musical instrument as claimed in claim 7 wherein the plurality of operators are arranged in a specified operator order; and wherein the change means is capable of canceling the musical tones mapped to each of the plurality of operators and mapping the musical tones to other operators without assigned musical tones in accordance with the changed state of the musical tone mapping, the other operators having a particular ordered relationship with respect to the plurality of operators to which the musical tone mapping was canceled.

13. An electronic musical instrument having a plurality of operators, including a first operator and a last operator arranged in a specified order, wherein each operator is capable of being assigned a musical tone and wherein a start instruction which commences the reproduction of the musical tones that are assigned can be initiated in conformance with the operation of each operator in the specified order of the operators, comprising:

a storage means in which assignment information is stored, wherein the assignment information indicates the musical tone that has been assigned to a particular operator;

an assignment change direction means in which changes in the state of the musical tone assignments for said operators are directed;

an assignment change means, wherein the musical tones previously assigned to any of the operators are reassigned by means of rewriting the assignment information that has been stored in the storage means in conformance with the direction of the change in the state of the musical tone assignment by the assignment change direction means; and a reproduction means for reproducing the musical tones in accordance with the operation of the operator to which each musical tone is assigned;

wherein the reassignment of musical tones previously assigned to any of the plurality of operators comprises reassigning the musical tones to lower ordered operators such that all musical tones are stored in a contiguous group of operators beginning with a lowest ordered operator while maintaining the musical tones in an order as determined by the order of the operators to which the musical tones were assigned.

14. An electronic musical instrument as claimed in claim 13, the electronic musical instrument further comprises:

a plurality of patterns, for assigning the musical tones to the operators, wherein the patterns of musical tone assignment to said plurality of operators are established in a plurality of varieties; and wherein reassignments of musical tones by the assignment change means are performed independently in specified assignment patterns from among the plurality of patterns.

15. An electronic musical instrument having a plurality of operators, including a first operator and a last operator arranged in a specified order, wherein each operator is capable of being assigned a musical tone and wherein a start instruction which commences the reproduction of the musical tones that are assigned can be initiated in conformance with the operation of each operator in the specified order of the operators, comprising:

a plurality of patterns for assigning the musical tones to the operators, wherein the plurality of patterns are established in a plurality of varieties; and wherein the patterns are arranged in a specified order;

a pattern designation means in which a pattern is designated from among the plurality of patterns for the assignment of a musical tone to an operator;

a storage means in which assignment information is stored, wherein the assignment information indicates the assignment of the musical tones to the operators in the patterns;

an assignment change direction means in which changes in the state of the musical tone assignments for said operators are directed;

an assignment change means, wherein the musical tones previously assigned to any of the operators in two or more of the patterns are reassigned in the order of the patterns and in the order of the operators to which said musical tones have been assigned from a first operator to a last operator of a first pattern and, from a first operator to a last operator in each subsequently assigned pattern by means of rewriting the assignment information that has been stored in said storage means in conformance with the direction of a change in the state of the musical tone assignment by said assignment change direction means; and a reproduction means for reproducing the musical tones in accordance with the operation of the operator to which each musical tone is assigned, wherein the operator has been operated in the pattern that has been designated in said pattern designation means.

16. An electronic musical instrument having a plurality of first operators, each of which is capable of being assigned a musical tone, and being operated to start a reproduction of the assigned musical tones, the electronic musical instrument comprising:

an operating panel for initiating assignments and transfers of musical tones between the plurality of first operators; and a processor in communication with the operating panel and programmed for selecting at least one first operator from the plurality of first operators in response to a user command entered from the operating panel, canceling the musical tones assigned to the selected at least one first operator, storing representations of the canceled musical tones, selecting at least one other first operator from the plurality of first operators, and assigning the stored representations of the canceled musical tones to the selected at least one other first operator.

17. An electronic musical instrument as recited in claim 16:

wherein musical tones are capable of being assigned to the plurality of first operators in a plurality of selectable patterns; and wherein canceled musical tones previously assigned to first operators in any of the patterns are assignable to first operators in other patterns.

18. An electronic musical instrument comprising:

a plurality of first operators, each first operator capable of being assigned a musical tone;

a second operator disposed on the operating panel and capable of being temporarily assigned a musical tone;

an operating panel for initiating assignments and transfers of musical tones between the plurality of first operators and the second operator; and a processor in communication with the operating panel and programmed for selecting at least one first operator from the plurality of first operators in response to user commands entered from the operating panel, canceling the musical tones assigned to the selected at least one first operator, assigning the canceled musical tones to the second operator, selecting at least one other first operator from the plurality of first operators, and assigning the musical tones assigned to the second operator to the selected at least one other first operator in response to user commands entered from the operating panel.

19. An electronic musical instrument as recited in claim 18, wherein the electronic musical instrument is capable of reproducing the musical tones assigned to the second operator in response to the operation of the second operator.

20. An electronic musical instrument as recited in claim 18, wherein after assigning the musical tones assigned to the second operator to the selected at least one other first operator, the musical tones assigned to the second operator are canceled.

21. An electronic musical instrument as recited in claim 20, the electronic musical instrument further comprising at least one display device disposed on the operating panel and in communication with the processor for indicating whether musical tones have been assigned to the second operator;

wherein the at least one display device is capable of indicating which of the plurality of first operators have been assigned musical tones.

22. An electronic musical instrument having a plurality of operators which can be mapped to musical tones such that a state of musical tone mapping is established, the electronic musical instrument comprising:

memory for storing management information indicating the state of musical tone mapping for each of the plurality of operators;

a processor in communication with the memory and programmed for changing the state of musical tone mapping for each of the plurality of operators and the management information in response to a stimulus from a user; and a plurality of display devices in communication with the memory and the processor for displaying the state of musical tone mapping for each of the plurality of operators, each display device corresponding to one of the plurality of operators;

wherein the processor is programmed for controlling the plurality of display devices based on the management information stored in the memory.

23. An electronic musical instrument as recited in claim 22:

wherein the state of musical tone mapping for the plurality of operators may be stored in the memory in a plurality of patterns;

wherein the management information stored in the memory includes information that indicates the state of musical tone mapping for each of the plurality of operators in each of the plurality of patterns and a specific pattern that is currently selected from among the plurality of patterns;

wherein changing the state of musical tone mapping for each of the plurality of operators by the processor includes selecting a pattern; and wherein the processor is programmed for controlling the plurality of display devices based on information from the selected pattern indicating the state of musical tone mapping for each of the plurality of operators in the selected pattern.

24. An electronic musical instrument as recited in claim 22, the electronic musical instrument further comprising a musical tone input device in communication with the processor for receiving musical tones;

wherein the processor is programmed for controlling the mapping of the musical tones received by the musical tone input device to one operator in the plurality of operators; and wherein the processor is programmed for updating the management information indicating the state of musical tone mapping for the operator to which the musical tones received by the musical tone input device have been mapped.

25. An electronic musical instrument as recited in claim 24, the processor further programmed for controlling the plurality of display devices to produce a first display mode identifying the operators from among the plurality of operators to which musical tones have been mapped, a second display mode identifying the operators from among the plurality of operators to which musical tones have not been mapped, and a third display mode identifying the operator to which musical tones received by the musical tone input device have been mapped.

26. An electronic musical instrument as recited in claim 22, the processor further programmed for selecting at least one first operator from the plurality of operators in response to a user command entered from the operating panel, canceling the musical tones assigned to the selected at least one first operator, selecting at least one second operator from the plurality of operators, and assigning the canceled musical tones to the selected at least one second operator; and a processor programmed for updating the management information according to the reassignment of musical tones from the selected at least one first operator to the selected at least one second operator.

27. An electronic musical instrument as recited in claim 22, wherein the plurality of operators are arranged in a specified order, the processor further programmed for selecting at least one first operator from the plurality of operators, canceling the musical tones assigned to the selected at least one first operator, selecting at least one second operator from the plurality of operators without assigned musical tones, the selected at least one second operator having a particular ordered relationship with respect to the selected at least one first operator, and mapping the canceled musical tones to the selected at least one second operator.

28. An electronic musical instrument having a plurality of operators, including a first operator and a last operator arranged in a specified order, wherein each operator is capable of being assigned a musical tone, and wherein a start instruction which commences a reproduction of assigned musical tones can be initiated in conformance with the operation of each operator in the specified order of the operators, the electronic musical instrument comprising:

memory for storing assignment information indicating the musical tone that has been assigned to a particular operator;

a processor programmed for directing changes in the assignment information for the operators and for reassigning the musical tones previously assigned to any of the plurality of operators by rewriting the assignment information; and a reproduction device for reproducing the musical tones in accordance with the operation of the operator to which each musical tone is assigned;

wherein the reassignment of musical tones previously assigned to any of the plurality of operators comprises reassigning the musical tones to lower ordered operators such that all musical tones are stored in a contiguous group of operators beginning with a lowest ordered operator while maintaining the musical tones in an order as determined by the order of the operators to which the musical tones were assigned.

29. An electronic musical instrument as recited in claim 28:

wherein musical tones are capable of being mapped to the plurality of operators in a plurality of patterns; and wherein the reassignment of a particular pattern of musical tones by the processor is performed in specified assignment patterns from among the plurality of patterns, each reassignment of a particular pattern occurring independently from other patterns.

30. An electronic musical instrument having a plurality of operators, including a first operator and a last operator arranged in a specified order, wherein each operator is capable of being assigned a musical tone, and wherein a start instruction which commences a reproduction of assigned musical tones can be initiated in conformance with the operation of each operator in the specified order of the operators, the electronic musical instrument comprising:

a plurality of patterns for assigning the musical tones to the operators, wherein the plurality of patterns are established in a plurality of varieties and wherein the plurality of patterns are arranged in a specified order;

a memory in which assignment information is stored, the assignment information indicating the assignment of the musical tones to the operators in the patterns;

a processor programmed for reassigning musical tones previously assigned to any of the operators in two or more of the patterns in a specified sequence from a first operator to a last operator of a first pattern and from a first operator to a last operator in each subsequently assigned pattern, by rewriting the assignment information stored in the memory in conformance with the specified sequence; and a reproduction device for reproducing the reassigned musical tones;

wherein the reassignment of musical tones previously assigned to any of the plurality of operators comprises reassigning the musical tones to lower ordered operators such that all musical tones are stored in a contiguous group of operators beginning with a lowest ordered operator while maintaining the musical tones in an order as determined by the order of the operators to which the musical tones were assigned.

31. An electronic musical instrument having a plurality of first operators, each of which is capable of being assigned a musical tone, and being operated to start a reproduction of the assigned musical tones, the instrument comprising:

a first control means for selecting at least one first operator from among said plurality of first operators in response to a stimulus from a user, and with the cancellation of the assignment to said at least one first operator that has been selected of the musical tone that had previously been assigned to said selected first operator, for storing the musical tone that had previously been assigned to a pointer that indicates the musical tone that had previously been assigned to said selected first operator; and a second control means for selecting at least one other first operator from among said plurality of operators in response to the stimulus from a user, and for assigning pointers that indicate the musical tones which have been stored in said first control means to the at least one other selected first operator.

* * * * *